US006558511B2

(12) United States Patent
Dwiggins et al.

(10) Patent No.: US 6,558,511 B2
(45) Date of Patent: May 6, 2003

(54) SOFT BULKY MULTI-PLY PRODUCT AND METHOD OF MAKING THE SAME

(75) Inventors: John H. Dwiggins, Neenah, WI (US); Frank D. Harper, Neenah, WI (US); Galyn A. Schulz, Greenville, WI (US); Brian J. Schuh, Appleton, WI (US); Michael S. Heath, Menasha, WI (US); T. Philips Oriaran, Appleton, WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 10/026,296

(22) Filed: Dec. 21, 2001

(65) Prior Publication Data

US 2002/0104630 A1 Aug. 8, 2002

Related U.S. Application Data

(62) Division of application No. 09/728,398, filed on Dec. 1, 2000, now Pat. No. 6,365,000.

(51) Int. Cl.[7] ..... B31F 1/12

(52) U.S. Cl. ..... 162/112

(58) Field of Search ..... 162/123–133, 162/111–113, 117, 116, 204–207, 164.6, 166, 169, 135–137; 264/282–284; 428/152–154, 195, 211, 221, 537.5

(56) References Cited

U.S. PATENT DOCUMENTS

| | | | | |
|---|---|---|---|---|
| 3,554,862 A | | 1/1971 | Hervey et al. | |
| 3,554,863 A | | 1/1971 | Hervey et al. | |
| 3,620,911 A | | 11/1971 | Eklund et al. | |
| 3,755,220 A | * | 8/1973 | Freimark et al. | 162/158 |
| 3,844,880 A | | 10/1974 | Meisek, Jr. et al. | |
| 4,064,213 A | | 12/1977 | Lazorisak et al. | |
| 4,094,718 A | | 6/1978 | Czerwin | |
| 4,304,625 A | | 12/1981 | Grube et al. | |
| 4,501,640 A | | 2/1985 | Soerens | |
| 4,528,316 A | | 7/1985 | Soerens | |
| 4,537,634 A | | 8/1985 | Floyd | |
| 4,547,580 A | | 10/1985 | Floyd | |
| 4,603,176 A | | 7/1986 | Bjorkquist et al. | |
| 4,605,702 A | | 8/1986 | Geurro et al. | |
| 4,625,029 A | | 11/1986 | Floyd et al. | |
| 4,656,296 A | | 4/1987 | Floyd | |
| 4,675,394 A | | 6/1987 | Solarek et al. | |
| 4,684,439 A | | 8/1987 | Soerens | |
| 4,720,383 A | | 1/1988 | Drach et al. | |
| 4,795,530 A | | 1/1989 | Soerens et al. | |
| 4,804,769 A | | 2/1989 | Solarek et al. | |
| 4,866,151 A | | 9/1989 | Tsai et al. | |
| 4,883,564 A | | 11/1989 | Chen et al. | |
| 4,886,579 A | | 12/1989 | Clark et al. | |
| 4,981,557 A | | 1/1991 | Bjorkquist | |
| 4,983,748 A | | 1/1991 | Tsai et al. | |
| 5,008,344 A | | 4/1991 | Bjorkquist | |
| 5,085,736 A | | 2/1992 | Bjorkquist | |
| 5,138,002 A | | 8/1992 | Bjorkquist | |
| 5,145,737 A | | 9/1992 | Boiron et al. | |
| 5,217,576 A | | 6/1993 | Phan | |
| 5,223,096 A | | 6/1993 | Phan et al. | |
| 5,225,047 A | | 7/1993 | Graef et al. | |
| 5,240,562 A | | 8/1993 | Phan et al. | |
| 5,246,544 A | | 9/1993 | Hollenberg et al. | |
| 5,262,007 A | | 11/1993 | Phan et al. | |
| 5,281,307 A | | 1/1994 | Smigo et al. | |
| 5,312,522 A | | 5/1994 | Van Phan et al. | |
| 5,320,710 A | | 6/1994 | Reeves et al. | |
| 5,354,425 A | | 10/1994 | Mackey et al. | |
| 5,374,334 A | | 12/1994 | Sommese et al. | |
| 5,382,323 A | | 1/1995 | Furman, Jr. et al. | |
| 5,399,241 A | | 3/1995 | Oriaran et al. | |
| 5,620,565 A | | 4/1997 | Lazorisak et al. | |
| 5,695,607 A | | 12/1997 | Oriaran et al. | |
| 5,882,479 A | | 3/1999 | Oriaran et al. | |
| 6,017,418 A | | 1/2000 | Oriaran et al. | |
| 6,176,972 B1 | | 1/2001 | Oriaran et al. | |
| 6,207,013 B1 | | 3/2001 | Oriaran et al. | |
| 6,419,790 B1 | * | 7/2002 | Leege et al. | 162/112 |

FOREIGN PATENT DOCUMENTS

| | | |
|---|---|---|
| EP | 0 616 074 A1 | 3/1994 |
| EP | 0 675 225 A2 | 10/1995 |

* cited by examiner

*Primary Examiner*—Jose A. Fortuna
(74) *Attorney, Agent, or Firm*—Nixon Peabody LLP

(57) ABSTRACT

The present invention is an ultra soft, multi-ply tissue made from non-premium furnish using wet press technology.

37 Claims, 10 Drawing Sheets

| DIM# | DESCRIPTION | DIM (mils) |
|---|---|---|
| 1 | LENGTH, TOP OF MALE ELEMENT | 2.3 |
| 2 | LENGTH, BOTTOM OF FEMALE ELEMENT | 2.3 |
| 3 | CD REPEAT OF MICRO | 92.6 |
| 4 | LENGTH, OPENING OF FEMALE ELEMENT | 35 |
| 5 | LENGTH, BASE OF MALE ELEMENT | 35 |
| 6 | WIDTH, TOP OF MALE ELEMENT | 23 |
| 7 | NO REPEAT OF MICRO | 92.5 |
| 8 | WIDTH, BASE OF FEMALE ELEMENT | 23 |
| 9 | WIDTH, OPENING OF FEMALE ELEMENT | 35 |
| 10 | WIDTH, BASE OF MALE ELEMENT | 35 |
| 11 | TOP OF MALE TO DEPTH OF FEMALE | 31 |
| 12 | TOP OF MALE TO MIDPLANE | 15.5 |
| 13 | MIDPLANE TO BOTTOM OF FEMALE | 15.5 |
| 14 | BOTTOM OF FEMALE DOME | 53 |

| DIM# | DESCRIPTION | DIM (mils) |
|---|---|---|
| 15 | OPENING FOR FEMALE DOME | 77 |
| 16 | BOTTOM OF FEMALE TULIP LINE | 20 |
| 17 | OPENING FOR FEMALE TULIP LINE | 44 |
| 18 | DEPTH OF FEMALE DOME | 31 |
| 19 | DEPTH OF FEMALE TULIP LINE | 31 |

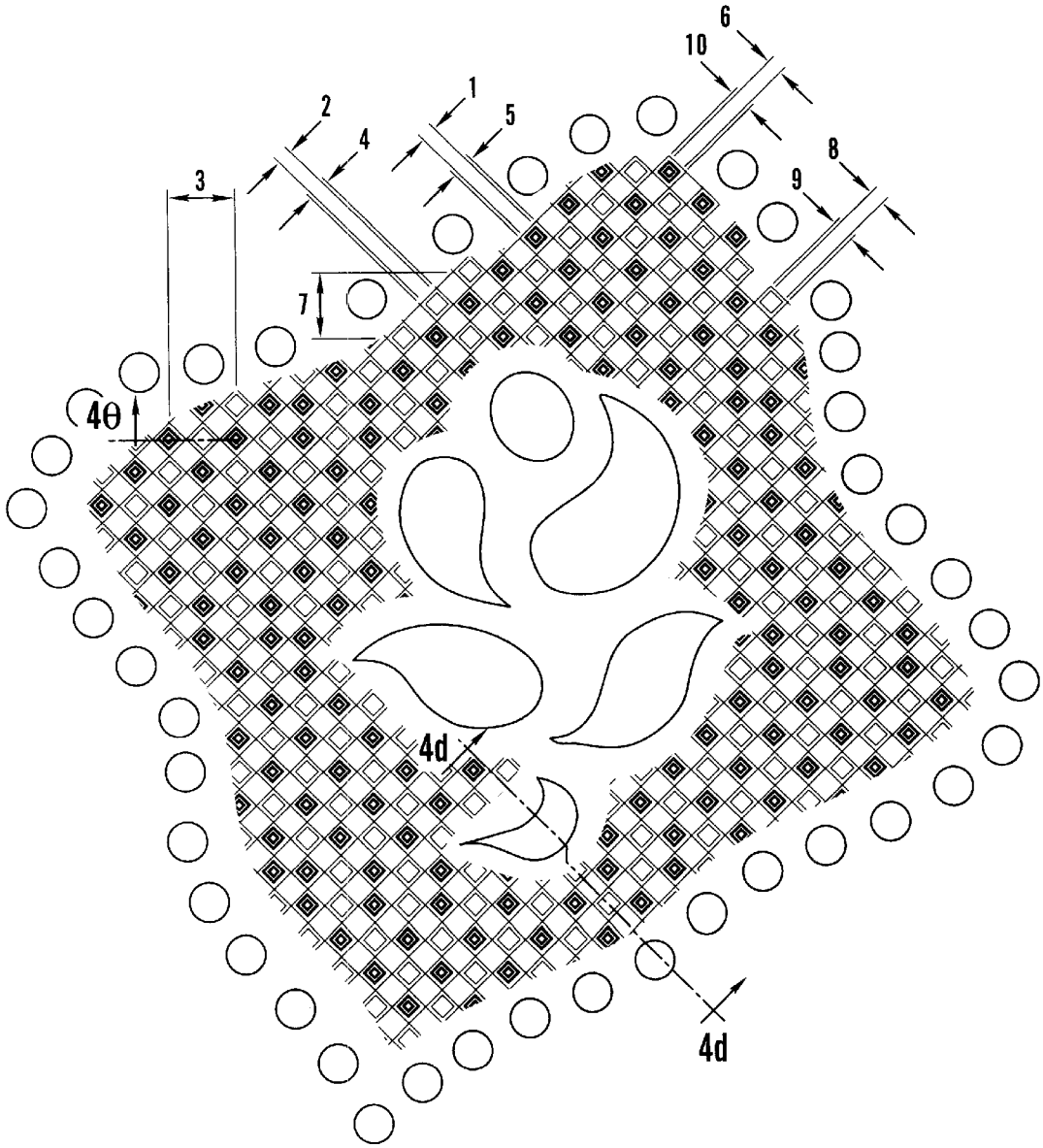

*FIG. 8a*

| DIM# | DESCRIPTION | DIM (mils) |
|---|---|---|
| 1 | LENGTH, TOP OF MALE ELEMENT | 23 |
| 2 | LENGTH, BOTTOM OF FEMALE ELEMENT | 23 |
| 3 | CD REPEAT | 92.5 |
| 4 | LENGTH, OPENING OF FEMALE ELEMENT | .15 |
| 5 | LENGTH, BASE OF MALE ELEMENT | .15 |
| 6 | WIDTH,TOP OF MALE ELEMENT | 23 |
| 7 | NO REPEAT | 92.5 |

| DIM# | DESCRIPTION | DIM (mils) |
|---|---|---|
| 8 | WIDTH, BASE OF FEMALE ELEMENT | 23 |
| 9 | WIDTH, OPENING OF FEMALE ELEMENT | .15 |
| 10 | WIDTH, BASE OF MALE ELEMENT | .15 |
| 11 | TOP OF MALE TO DEPTH OF FEMALE | 31 |
| 12 | TOP OF MALE TO MIDPLANE | 15.5 |
| 13 | MIDPLANE TO BOTTOM OF FEMALE | 15.5 |
| 14 | TOP OF MALE DOMES | 53 |
| 15 | BOTTOM OF MALE DOMES | 77 |
| 16 | TOP OF MALE TULIP LINE | 20 |
| 17 | BASE OF MALE TULIP LINE | 44 |
| 18 | HEIGHT OF DOMES | .31 |
| 19 | HEIGHT OF TULIP LINES | .31 |

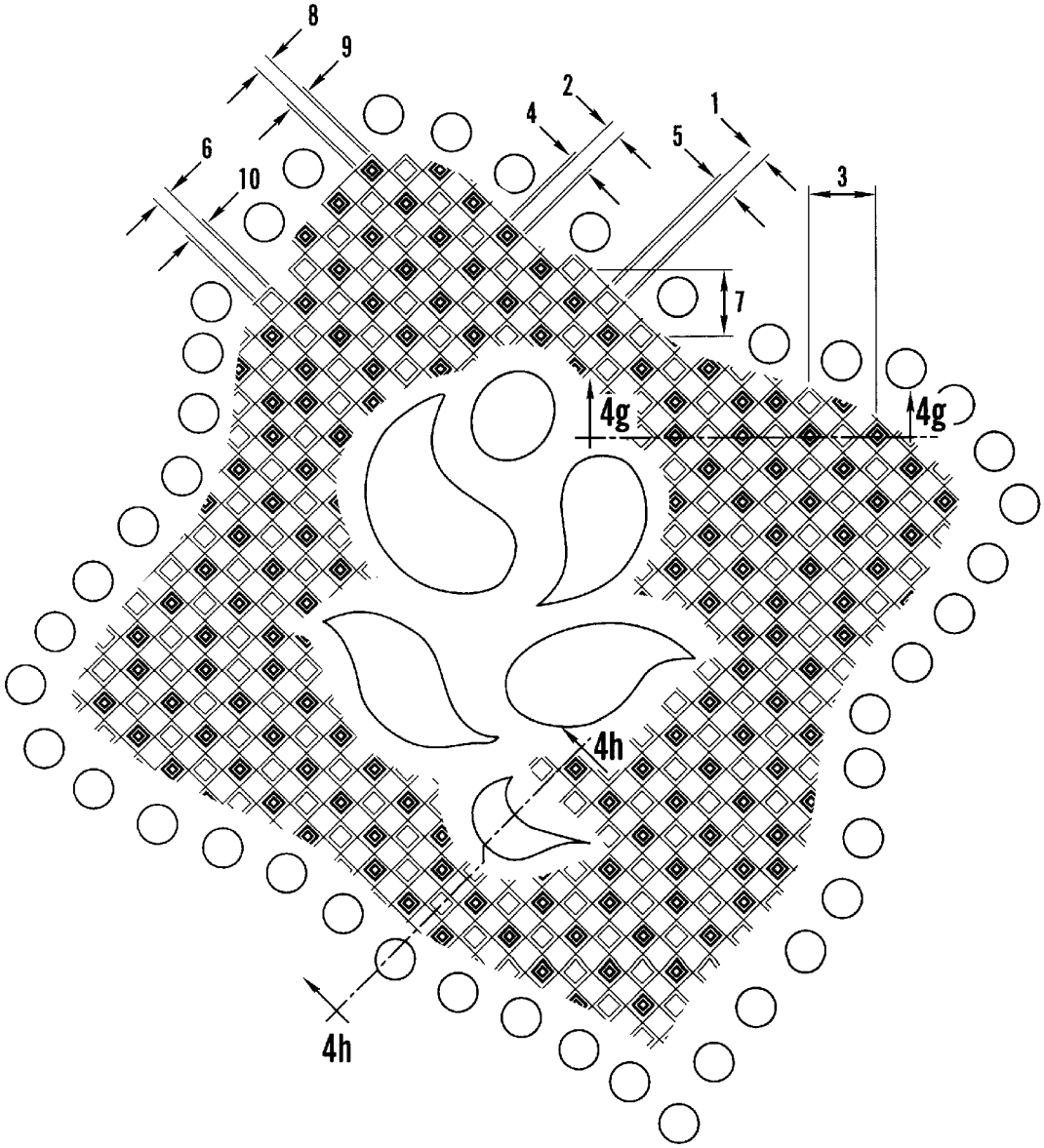

*FIG. 8b*

SOFT BULKY MULTI-PLY PRODUCT AND METHOD OF MAKING THE SAME

The present application is a division of U.S. patent application Ser. No. 09/728,398, entitled A SOFT BULKY MULTI-PLY PRODUCT AND METHOD OF MAKING THE SAME, filed Dec. 1, 2000, now U.S. Pat. No. 6,365,000 which is herein incorporated by reference in its entirety.

FIELD OF THE INVENTION

The present invention is directed to a method of making an improved ultra soft, multi-ply product. More particularly, the present invention is directed to a method of making an ultra soft, multi-ply tissue from non-premium, high coarseness, or secondary fiber furnish. Still further, the present invention is directed to improving the CD tensile energy absorption of a multi-ply product. Finally, the present invention is directed to an ultra soft bathroom tissue produced according to the described method.

BACKGROUND OF THE INVENTION

In the area of bathroom tissue, softness, absorbency and strength are key attributes considered by consumers. It is highly desirable that the tissue product have a consumer perceived feel of softness. This softness plays a key role in consumer preference. Softness relates both to the product bulk and surface characteristics. In addition to softness, the consumer desires a product that is both strong and absorbent to minimize the amount of the product which must be used to do an effective job.

The method of the present invention uses wet press technology to prepare a strong, ultra soft tissue having a high basis weight. The tissue produced by the method of the present invention exhibits good strength and absorbency while remaining extremely soft. The method according to the present invention results in a product having improved CD tensile energy absorption, which bears substantial correspondence to consumer perceptions of strength. Properties such as those exhibited by the tissue of the present invention have not heretofore been seen in wet-press tissue products.

In a conventional wet press (CWP) process and apparatus (10), as exemplified in FIG. 1, a furnish is fed from a silo (50) through conduits (40, 41) to headbox chambers (20, 20'). A web (W) is formed on a conventional wire former (12), supported by rolls (18, 19), from a liquid slurry of pulp, water and other chemicals. Materials removed from the web of fabric in the forming zone when pressed against a forming roll (15) are returned to a silo (50), from a saveall (22) through a conduit (24). The web is then transferred to a moving felt or fabric (14), supported by a roll (11) for drying and pressing. Materials removed from the web during drying and pressing or from a Uhle box (29) are collected in a saveall (44) and fed to a white water conduit (45). The web is then pressed by a suction press roll (16) against the surface of a rotating Yankee dryer cylinder (26) which is heated to cause the paper to substantially dry on the cylinder surface. The moisture within the web as it is laid on the Yankee surface causes the web to transfer to the surface. Liquid adhesive may be applied to the surface of the dryer to provide substantial adherence of the web to the creping surface. The web is then creped from the surface with a creping blade (27). The creped web is then usually passed between calender rollers (30) and rolled up on a roll (28) prior to further converting operations, for example, embossing. The action of the creping blade on the paper is known to cause a portion of the interfiber bonds within the paper to be broken up by the mechanical smashing action of the blade against the web as it is being driven into the blade. However, fairly strong interfiber bonds are formed between the wood pulp fibers during the drying of the moisture from the web. The strength of these bonds in prior art tissues is such that, even after creping, the web retains a perceived feeling of hardness, a fairly high density, and low-bulk and water absorbency.

To reduce the strength of the interfiber bonds that inevitably result when wet pressing and drying a web from a slurry, various processes have been utilized. One such process is the passing of heated air through the wet fibrous web after it is formed on a wire and transferred to a permeable carrier—a so-called through-air-dried (TAD) process—so that the web is not compacted prior to being dried. The lack of compaction, such as would occur when the web is pressed while on a felt or fabric and against the drying cylinder when it is transferred thereto, reduces the opportunity for interfiber bonding to occur, and allows the finished product to have greater bulk than can be achieved in a wet press process. Because of the consumer perceived softness of these products, and their greater ability to absorb liquids than webs formed in wet press processes, the products formed by the newer processes enjoy an advantage in consumer acceptance.

Felted wet press processes are significantly more energy efficient than processes such as through-air-drying since they do not require heating and moving large quantities of air as required by the TAD process. In wet press operations, excess moisture is mechanically pressed from the web and the final drying of the web is obtained chiefly on the heated Yankee drying cylinder which is maintained at the proper drying temperature.

The present invention provides a method for making a tissue product that achieves high strength, bulk, absorbency, and softness above existing conventional wet-pressed tissue, approaching or achieving levels even beyond those found using through-air-drying. The process according to the present invention uses the cheaper more efficient wet press process and also uses less expensive, non-premium fibers.

SUMMARY OF THE INVENTION

Further advantages of the invention will be set forth in part in the description which follows. The advantages of the invention may be realized and attained by means of the instrumentalities and combinations particularly pointed out in the appended claims.

To achieve the foregoing advantages and in accordance with the purpose of the invention as embodied and broadly described herein, there is disclosed:

A method of making an ultra-soft high basis weight multi-ply tissue including:

(a) providing a fibrous pulp furnish wherein the total furnish has a fiber coarseness of at least about 11 mg/100 meters;

(b) forming a first nascent web from the furnish;

(c) including in the first web at least about 1.0 lbs/ton of a cationic nitrogenous softener;

(d) dewatering the first web through wet pressing;

(e) adhering the first web to a Yankee dryer;

(f) creping the first web from the Yankee dryer at a reel crepe of at least about 20%;

(g) forming a second nascent web as recited in steps (a)–(f) above;

(h) combining the first web with the second web to form a multi-ply web;

(i) embossing the multi-ply web between mated emboss rolls, each of which contains both male and female elements;

(j) optionally calendering the embossed multi-ply web; and wherein steps (a)–(j) are controlled to result in a multi-ply tissue product having an MD tensile strength of about 21 to about 50 g/3" width per lb. of basis weight; a CD tensile strength of about 10 to about 23 g/3" width per lb. of basis weight; a caliper of at least about 3 mils/8 plies/lb. basis weight; a GM MMD friction of less than about 0.21; and a tensile stiffness of less than about 1 (g/inch/% strain)/(lb/ream); and a CD tensile absorption energy according to the following relationship $$\text{CD TEA} \geqq \text{CDT}*0.00085-0.105.$$

There is further disclosed an ultra soft, high absorbency product produced by the above-described method.

Finally there is disclosed:

An embossed multi-ply tissue product including at least two paper webs each having a fiber coarseness of at least about 11 mg/100 meters; an MD tensile strength of about 21 to about 50 g/3" width per lb. of basis weight; a CD tensile strength of about 10 to about 23 g/3" width per lb. of basis weight; a caliper of at least about 3 mils/8 plies/lb. basis weight; a GM MMD friction of less than about 0.21; a tensile stiffness of less than about 1 (g/inch/% strain)/(lb/Ream); and a CD tensile absorption energy according to the following relationship $$\text{CD TEA} \geqq \text{CDT}*0.00085-0.105.$$

BRIEF DESCRIPTION OF THE DRAWINGS

FIGS. 7*a* and 7*b* and 8*a* and 8*b* illustrate another emboss pattern for use according to the present invention.

DETAILED DESCRIPTION

Figure 1:
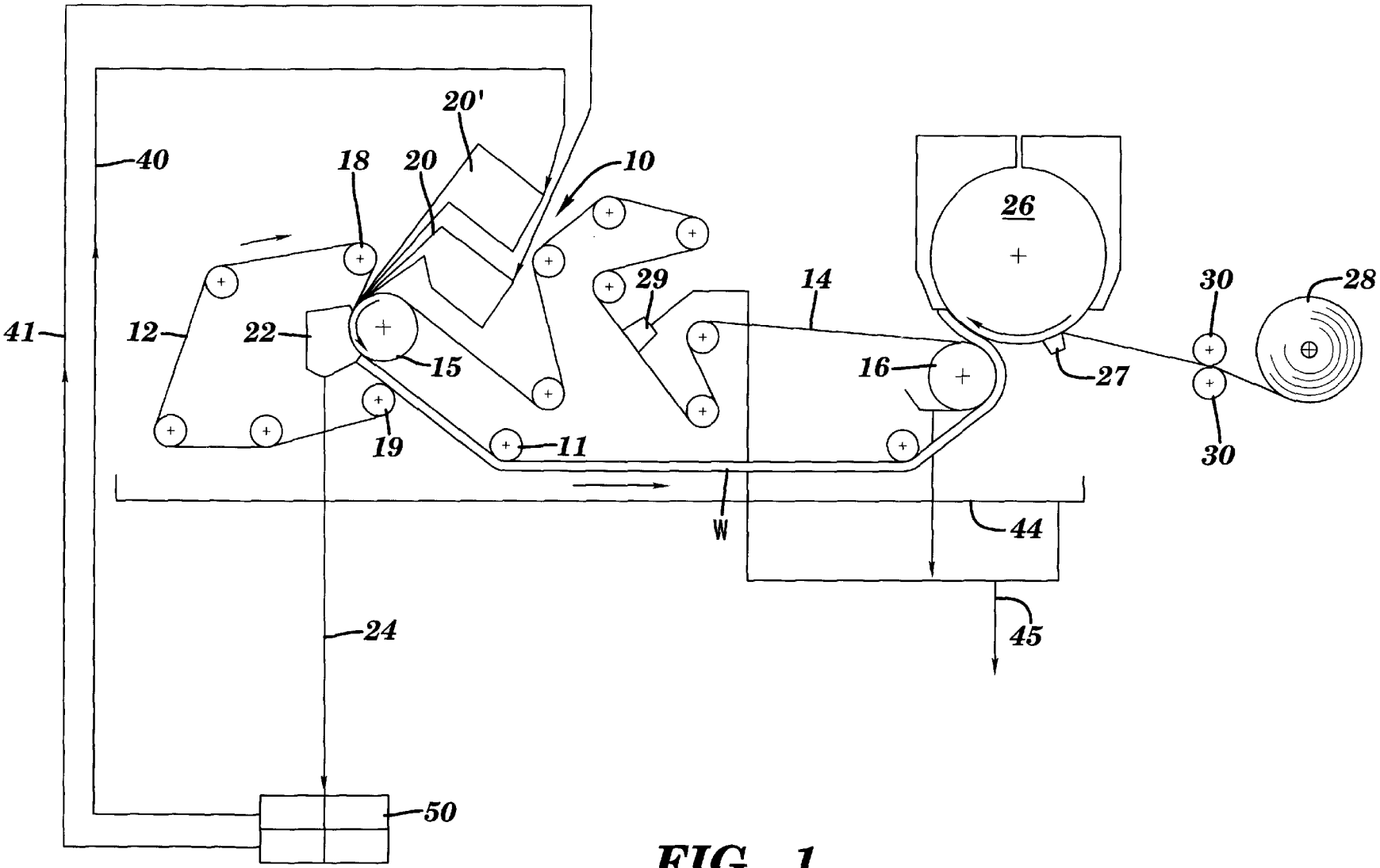
FIG. 1 is a preferred wet press processing apparatus for use in the present invention.
Figure 2:
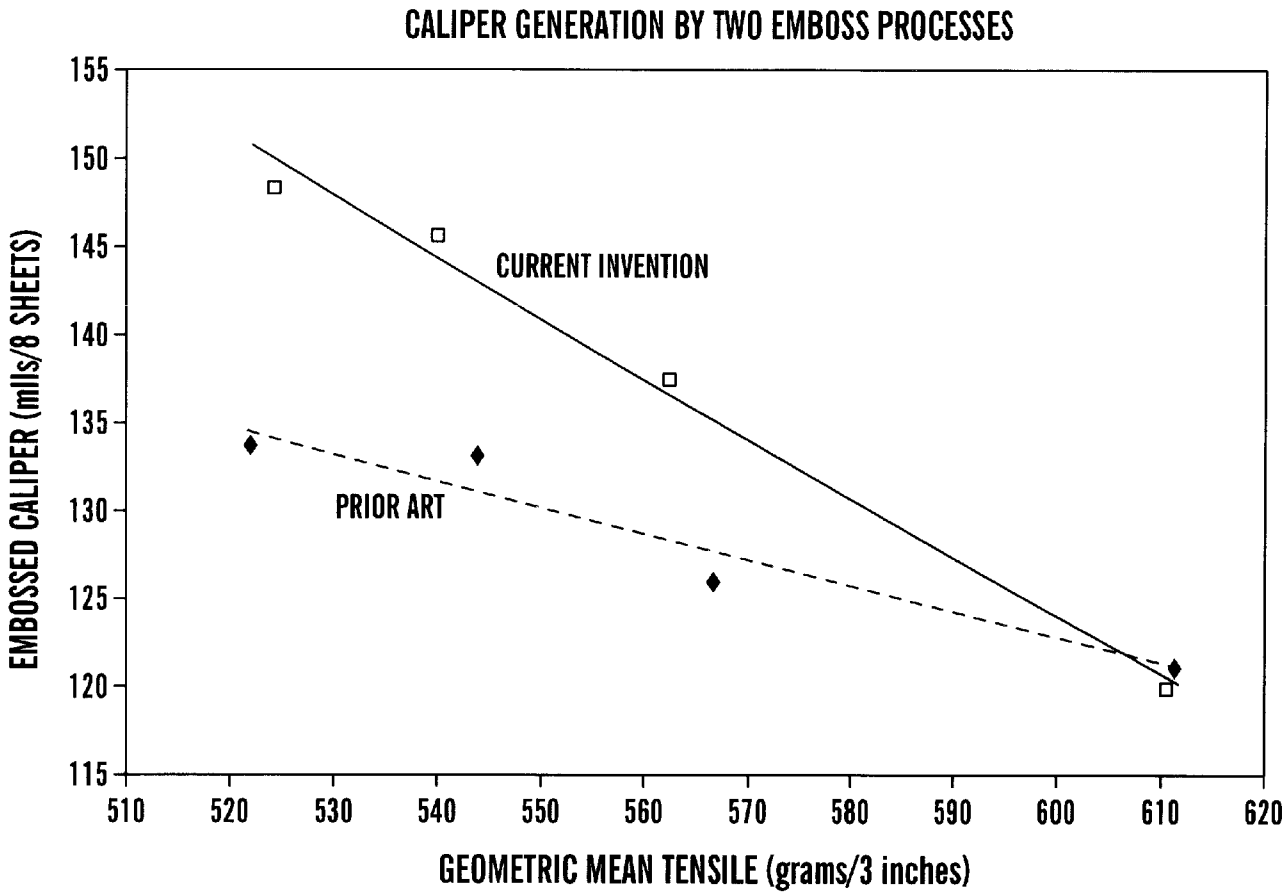
FIG. 2 is a graphical illustration of the GM tensile versus caliper for products produced according to the Prior Art and those produced according to the present invention.

The present invention relates to the production of an ultra-soft, high basis weight multi-ply tissue. As used herein, high basis weight refers to a product (one or more plies) having a basis weight of 22 or more lbs per 3000 sq. ft. (ream). As used herein, ultra-soft products are those having low values of tensile stiffness, friction deviation, or (usually) both. The tensile stiffness of ultra-soft products generally has values of 1.0 grams/inch/% strain per pound of basis weight or less, preferably 0.7 grams/inch/% strain per pound of basis weight or less. The friction deviation of ultra-soft products is usually no more than 0.210, preferably at 0.180 or less.

Until now, ultra-soft products have been made exclusively from low-coarseness hardwoods and softwoods. Low-coarseness hardwoods include those fibers having a coarseness value (as measured by the OPTest Fiber Quality Analyzer) of 10 mg/100 meters or less. Examples of low-coarseness hardwoods include Northern hardwood fibers, such as those obtained from maple and aspen, and various species of Eucalyptus. Low-coarseness softwoods have coarseness values in the 15 to 20 mg/100 m range and include Northern softwoods such as fir and spruce. An ultra-soft tissue product made from such fibers will have an overall coarseness value of about 11 mg/100 m or less. These fibers produce tissues having excellent formation and softness properties; however, they tend to be more costly than their Southern and Western counterparts. However, CWP products made exclusively from these low-coarseness fibers may be perceived by users as being thin.

Papermaking fibers used to form the soft absorbent, products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention, including non-woody fibers liberated from sugar cane, bagasse, sabai grass, rice straw, banana leaves, paper mulberry (i.e, bast fiber), abaca leaves, pineapple leaves, esparto grass leaves, and fibers from the genus Hesperaloe in the family Agavaceae. Also recycled fibers which may contain any of the above fibers sources in different percentages can be used in the present invention. Suitable fibers are disclosed in U.S. Pat. Nos. 5,320,710 and 3,620,911, each of which is incorporated herein by reference in its entirety.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if one wishes, by a number of familiar bleaching schemes including alkaline peroxide and ozone bleaching. The type of furnish is less critical than is the case for prior art products. A significant advantage of our process over the prior art processes is that coarse hardwoods and softwoods and significant amounts of recycled fiber can be utilized to create a soft product in our process while prior art products had to utilize more expensive low-coarseness softwoods and low-coarseness hardwoods such as eucalyptus.

Fiber length and coarseness can be measured using the model LDA96 Fiber Quality Analyzer, available from OpTest Equipment Inc. of Hawkesbury, Ontario, Canada. These parameters can be determined using the procedure outlined in the instrument's operating manual. In general, determination of these values involves first accurately weighing a pulp sample (10–20 mg for hardwood, 25–50 mg for softwood) taken from a one-gram handsheet made from the pulp. The moisture content of the handsheet should be accurately known so that the actual amount of fiber in the sample is known. This weighed sample is then diluted to a known consistency (between about 2 and about 10 mg/l) and a known volume (usually 200 ml) of the diluted pulp is sampled. This 200 ml sample is further diluted to 600 ml and placed in the analyzer. The final consistency of pulp slurry that is used to measure coarseness is generally between about 0.67 and 3.33 mg/liter. The weight of pulp in this sample may be calculated from the sample volume and the original weight and moisture content of the pulp that was sampled from the handsheet. This weight is entered into the analyzer and the coarseness test is run according to the operating manual's instructions.

Coarseness values are usually reported in mg/100 meters. Fiber lengths are reported in millimeters. For instruments of this type, three average fiber length measurements are usually reported. These measurements are often referred to as the number-weighted or arithmetic average fiber length ($l_n$), the length-weighted fiber length ($l_w$) and the weight-weighted fiber length ($l_z$). The arithmetic average length is the sum of the product of the number of fibers measured and the length of the fiber divided by the sum of the number of fibers measured. The length-weighted average fiber length is defined as the sum of the product of the number of fibers measured and the length of each fiber squared divided by the sum of the product of the number of fibers measured and the length of the fiber. The weight-weighted average fiber length is defined as the sum of the product of the number of fibers measured and the length of the fiber cubed divided by the sum of the product of the number of fibers and the length of the fiber squared. It is the weight-weighted fiber length that is used in describing the fiber lengths of the current invention.

A major advantage of the current invention is that it allows use of coarser hardwoods and softwoods to produce ultra-soft tissues. Hardwoods having coarseness values of up to about 15 mg/100 m and softwoods with a coarseness of up to about 35 mg/100 m may be employed in the furnish, though, of course, lower-coarseness pulps may also be included in the furnish. These coarser fibers not only have the advantage of lower cost; but CWP products produced from such pulps are also often perceived by consumers as being thicker and stronger than similar tissues made from only low-coarseness fibers. The product of the present invention will typically include from about 30 to about 85 percent of a first fiber, typically a hardwood, having a coarseness of 15 mg/100 m or less and a fiber length of from about 0.8 to about 1.8 mm, more preferably having a coarseness of 13.5 mg/100 m or less and a fiber length of from about 0.8 to about 1.4 mm and most preferably having a coarseness of 12 or less and a fiber length of from about 0.8 to about 1.2 mm. The product will also include from about 15 to about 70 percent of a second fiber, typically a softwood having a coarseness of no more than about 35 mg/100 meters and a fiber length of at least about 2.0 mm, more preferably a coarseness of not more than about 30 mg/100 meters and a fiber length of at least about 2.2 mm and most preferably a coarseness of no more than about 25 mg/100 meters and a fiber length of at least about 2.5 mm. Other fibers including recycled fiber and non-woody fibers may also be included; however, if present, they would typically constitute no more than about 70 percent of the tissue's total furnish. Recycled fibers, if included, would usually replace both hardwood and softwood in a 3/1 to 4/1 HW/SW Ratio. The coarseness of the total furnish would typically be in the range of from about 11 to about 18 mg/100 meters.

The product of the current invention may be prepared either as a homogenous or a stratified product. If a stratified product is produced, each sheet would typically be composed of at least two layers. The first layer would constitute from about 20 to about 50 percent of the total sheet and would be made chiefly or entirely of the first fibers described above. This layer would be on the side of the sheet that is adhered to the Yankee dryer during papermaking and would appear on the outside of the final embossed product. The remaining layers of the sheet can be composed of the second fibers described above or blends of the first and second fibers. Optionally, other fibers or fiber blends such as recycled fiber and broke, if present, can be included. If such fibers are present, they are usually located chiefly or exclusively in the non-Yankee-side, i.e., air-side, layers.

In many cases, particularly when a stratified machine is used, starches and debonders can be advantageously used simultaneously. In other cases starches, debonders or mixtures thereof may be supplied to the wet end while softeners and/or debonders may be applied by spraying.

Suitable softeners and debonders, however, will be readily apparent to the skilled artisan. Suitable softeners and debonders are widely described in the patent literature. A comprehensive but non-exhaustive list includes U.S. Pat. Nos. 4,795,530; 5,225,047; 5,399,241; 3,844,880; 3,554,863; 3,554,862; 4,795,530; 4,720,383; 5,223,096; 5,262,007; 5,312,522; 5,354,425; 5,145,737, and EPA 0 675 225 each of which is specifically incorporated herein by reference in its entirety.

These softeners are suitably nitrogen containing organic compounds preferably cationic nitrogenous softeners and may be selected from trivalent and tetravalent cationic organic nitrogen compounds incorporating long fatty acid chains; compounds including imidazolines, amino acid salts, linear amine amides, tetravalent or quaternary ammonium salts, or mixtures of the foregoing. Other suitable softeners include the amphoteric softeners which may consist of mixtures of such compounds as lecithin, polyethylene glycol (PEG), castor oil, and lanolin.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry,* Jul. 5, 1969, pp. 893–903; Egan, *J. Am. Oil Chemist's Soc.,* Vol. 55 (1978), pp.118–121; and Trivedi et al, *J. Am. Oil Chemist's Soc.,* June 1981, pp. 754–756. All of the above are incorporated herein by reference in their entirety. As indicated therein, softeners are often available commercially only as complex mixtures rather than as single compounds. While this discussion will focus on the predominant species, it should be understood that commercially available mixtures would generally be used to practice this invention.

The softener having a charge, usually cationic, can be supplied to the furnish prior to web formation, applied directly onto the partially dewatered web or may be applied by both methods in combination. Alternatively, the softener may be applied to the completely dried, creped sheet, either on the paper machine or during the converting process. Softeners having no charge are applied at the dry end of the paper making process.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active basis, is suitably up to about 10 pounds per ton of furnish; preferably from about 0.5 to about 7 pounds per ton of furnish.

Imidazoline-based softeners that are added to the furnish prior to its formation into a web have been found to be particularly effective in producing soft tissue products and constitute a preferred embodiment of this invention. Of particular utility for producing the soft tissue product of this invention are the cold-water dispersible imidazolines. These imidazolines are mixed with alcohols or diols, which render the usually insoluble imidazolines water dispersible. Representative initially water insoluble imidazolines rendered water soluble by the water soluble alcohol or diol treatment include Witco Corporation's Arosurf PA 806 and DPSC 43/13 which are water dispersible versions of tallow and oleic-based imidazolines, respectively.

Treatment of the partially dewatered web with the softener can be accomplished by various means. For instance, the treatment step can constitute spraying, applying with a direct contact applicator means, or by employing an applicator felt. It is often preferred to supply the softener to the air side of the web so as to avoid chemical contamination of the paper making process. It has been found in practice that a softener applied to the web from either side penetrates the entire web and uniformly treats it.

Useful softeners for spray application include softeners having the following structure:

$$[(RCO)_2EDA]HX$$

wherein EDA is a diethylenetriamine residue, R is the residue of a fatty acid having from 12 to 22 carbon atoms, and X is an anion or $$[(RCONHCH_2CH_2)_2NR']HX$$

wherein R is the residue of a fatty acid having from 12 to 22 carbon atoms, R' is a lower alkyl group, and X is an anion.

More specifically, preferred softeners for application to the partially dewatered web are Quasoft® 218, 202, and 209-JR made by Quaker Chemical Corporation which contain a mixture of linear amine amides and imidazolines Another suitable softener is a dialkyl dimethyl fatty quaterary ammonium compound of the following structure:

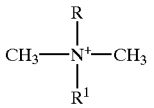

wherein R and $R^1$ are the same or different and are aliphatic hydrocarbons having fourteen to twenty carbon atoms preferably the hydrocarbons are selected from the following: $C_{16}H_{35}$ and $C_{18}H_{37}$.

A new class of softeners are imidazolines which have a melting point of about 0–40° C. in aliphatic diols, alkoxylated aliphatic diols, or a mixture of aliphatic diols and alkoxylated aliphatic diols. These are useful in the manufacture of the tissues of this invention. The imidazoline moiety in aliphatic polyols, aliphatic diols, alkoxylated aliphatic polyols, alkoxylated aliphatic diols or in a mixture of these compounds, functions as a softener and is dispersible in water at a temperature of from about 1° C. to about 40° C. The imidazoline moiety is of the formula:

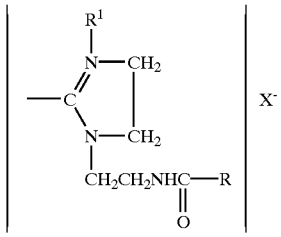

wherein X is an anion and R is selected from the group of saturated and unsaturated parafinic moieties having a carbon chain of $C_{12}$ to $C_{20}$ and $R^1$ is selected from the groups of methyl and ethyl moieties. Suitably the anion is methyl sulfate of the chloride moiety. The preferred carbon chain length is $C_{12}$ to $C_{18}$. The preferred diol is 2,2,4 trimethyl 1,3 pentane diol and the preferred alkoxylated diol is ethoxylated 2,2,4 trimethyl 1,3 pentane diol. A commercially available example of the type of softener is AROSURF® PA 806 manufactured by Witco Corporation of Ohio.

Preferred softeners and debonders include Quasoft®206, Quasoft® 216, and Quasoft® 230, manufactured by the Quaker Chemical Company of Conshohocken, Pa. and Varisoft® 475, Varisoft® 3690, and Arosurf® PA. 806, which are available from Witco of Ohio.

After the web is formed, it can be sprayed with from at least about 0.5 to about 3.5 lbs/ton of softener, more preferably about 0.5 to about 2 lbs/ton of softener. Alternatively, a softener may be incorporated into the wet end of the process to result in a web including at least 0.5 lbs/ton of softener. It will be understood by the skilled artisan that spraying of the softener may occur after two webs have been joined to form a two-ply product.

The pulp can be mixed with temporary wet strength-adjusting agents. The pulp preferably contains up to about 10 lbs/ton of one or more strength adjusting agents, more preferably up to about 5 lbs/ton, still more preferably 2 to 3 lbs. Suitable wet strength agents comprise an organic moiety and suitably include water soluble aliphatic dialdehydes or commercially available water soluble organic polymers comprising aldehydic units, and cationic starches containing aldehyde moieties. These agents may be used singly or in combination with each other.

Suitable temporary wet strength agents are aliphatic and aromatic aldehydes including glyoxal, malonic dialdehyde, succinic dialdehyde, glutaraldehyde, dialdehyde starches, polymeric reaction products of monomers or polymers having aldehyde groups and optionally nitrogen groups. Representative nitrogen containing polymers which can suitably be reacted with the aldehyde containing monomers or polymers include vinylamides, acrylamides and related nitrogen containing polymers. These polymers impart a positive charge to the aldehyde containing reaction product.

We have found that condensates prepared from dialdehydes such as glyoxal or cyclic urea and polyol both containing aldehyde moieties are useful for producing temporary wet strength. Since these condensates do not have a charge, they are added to the web before or after the pressing roll or charged directly on the Yankee surface. Preferably these temporary wet strength agents are sprayed on the air side of the web prior to drying on the Yankee.

The preparation of cyclic ureas is disclosed in U.S. Pat. No. 4,625,029 herein incorporated by reference in its entirety. Other U.S. Patents of interest disclosing reaction products of dialdehydes with polyols include U.S. Pat. Nos. 4,656,296; 4,547,580; and 4,537,634 and are also incorporated into this application by reference in their entirety. The dialdehyde moieties expressed in the polyols render the whole polyol useful as a temporary wet strength agent in the manufacture of tissue according to the present invention. Suitable polyols are reaction products of dialdehydes such as glyoxal with polyols having at least a third hydroxyl group. Glycerin, sorbitol, dextrose, glycerin monoacrylate, and glycerin monomaleic acid ester are representative polyols useful as temporary wet strength agents.

Polysaccharide aldehyde derivatives are suitable for use in the manufacture of tissue according to the present invention. The polysaccharide aldehydes are disclosed in U.S. Pat. Nos. 4,983,748 and 4,675,394. These patents are incorporated by reference in their entirety into this application. Suitable polysaccharide aldehydes have the following structure:

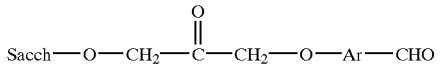

wherein Ar is an aryl group. This cationic starch is a representative cationic moiety suit-able for use in the manufacture of the tissue of the present invention and can be charged with the furnish.

A starch of this type can also be used without other aldehyde moieties but, in general, should be used in combination with a cationic softener.

Our novel tissue can suitably include polymers having non-nucleophilic water soluble nitrogen heterocyclic moieties in addition to aldehyde moieties. Representative resins of this type are:

A. Temporary wet strength polymers constituting aldehyde groups and having the formula:

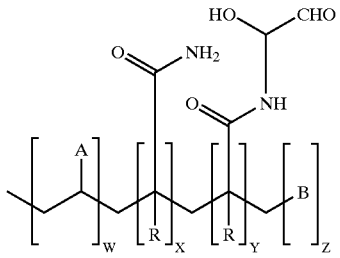

wherein A is a polar, non-nucleophilic unit which does not cause the resin polymer to become water-insoluble; B is a hydrophilic, cationic unit which imparts a positive charge to the resin polymer; each R is H, $C_1$–$C_4$ alkyl or halogen; wherein the mole percent of W is from about 58% to about 95%; the mole percent of X is from about 3% to about 65%; the mole percent of Y is from about 1% to about 20%; and the mole percent from Z is from about 1% to about 10%; the resin polymer having a molecular weight of from about 5,000 to about 200,000.

B. Water soluble cationic temporary wet strength polymers having aldehyde units which have molecular weights of from about 20,000 to about 200,000, and are of the formula:

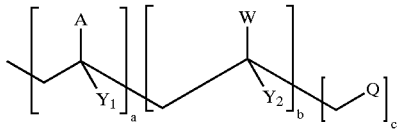

wherein A is

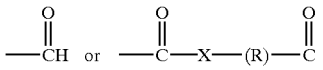

and X is —O—, —NH—, or —$NCH_3$— and R is a substituted or unsubstituted aliphatic group; $Y_1$ and $Y_2$ are independently —H, —$CH_3$, or a halogen, such as Cl or F; W is a nonnucleophilic, water-soluble nitrogen heterocyclic moiety; and Q is a cationic monomeric unit. The mole percent of "a" ranges from about 30% to about 70%, the mole percent of "b" ranges from about 30% to about 70%, and the mole percent of "c" ranges from about 1% to about 40%.

The temporary wet strength resin may be any one of a variety of water soluble organic polymers comprising aldehydic units and cationic units used to increase the dry and wet tensile strength of a paper product. Such resins are described in U.S. Pat. Nos.: 4,675,394; 5,240,562; 5,138,002; 5,085,736; 4,981,557; 5,008,344; 4,603,176; 4,983,748; 4,866,151; 4,804,769; and 5,217,576 each of which is incorporated herein by reference in its entirety. Among the preferred temporary wet strength resins that may be used in practice of the present invention are modified starches sold under the trademarks Co-Bond® 1000 and Co-Bond® 1000 Plus by National Starch and chemical Company of Bridgewater, N.J. Prior to use, the cationic aldehydic water soluble polymer is prepared by preheating an aqueous slurry of approximately 5% solids maintained at a temperature of approximately 240° Fahrenheit and a pH of about 2.7 for approximately 3.5 minutes. Finally, the slurry is quenched and diluted by adding water to produce a mixture of approximately 1% solids at less than about 130° F.

Co-Bond® 1000 is a commercially available temporary wet strength resin including an aldehydic group on cationic corn waxy hybrid starch. The hypothesized structure of the molecules are set forth as follows:

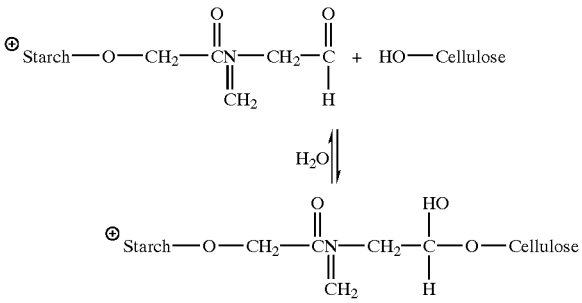

Other preferred temporary wet strength resins, also available from the National Starch and Chemical Company are sold under the trademark Co-Bond® 1600 and CoBond® 2300. These starches are supplied as aqueous colloidal dispersions and do not require preheating prior to use. In addition, other commercially available temporary wet strength agents such as Parez 745 manufactured by Cytec can be used, as well as those disclosed in U.S. Pat. No. 4,605,702.

Typical temporary strength adjusting agents are well known to the skilled artisan and the method and amounts for their effective use are also understood by the skilled artisan. Preferred temporary wet strength agents which may be used in the present invention include, but are not limited to, glyoxylated polyacrylamide, glyoxal and modified starches.

A first nascent web is then formed from the pulp. The web can be formed using any of the standard wet-press configurations known to the skilled artisan, e.g., crescent former, suction breast roll, twin-wire former, etc. Once the web is formed, it preferably has a basis weight, under TAPPI LAB CONDITIONS of at least about 11 lbs/3000 sq. ft. ream, preferably at least about 13.5 lbs/3000 sq. ft. ream, more preferably at least about 12–14 lbs/3000 sq. ft. ream. TAPPI LAB-CONDITIONS refers to TAPPI T402 test methods specifying time, temperature and humidity conditions for a sequence of conditioning steps.

The web is then dewatered preferably by an overall compaction process. The web is then preferably adhered to a Yankee dryer. Any suitable art recognized adhesive may be used on the Yankee dryer. Preferred adhesives include Houghton 8290 (H8290) adhesive, Houghton 82176 (H82176) adhesive, Quacoat A-252 (QA252), Betz creplus 97 (Betz+97), Calgon 675 B. Suitable adhesives are widely described in the patent literature. A comprehensive but non-exhaustive list includes U.S. Pat. Nos. 5,246,544; 4,304,625; 4,064,213; 4,501,640; 4,528,316; 4,883,564; 4,684,439; 4,886,579; 5,374,334; 5,382,323; 4,094,718; and 5,281,307. Typical release agents can be used in accordance with the present invention.

The web is then creped from the Yankee dryer and calendered. The relative speeds between the Yankee dryer and the reel are preferably controlled to such a level that a reel crepe of at least about 20%, more preferably 24% and most preferably 25% is maintained. Percent crepe is defined as the Yankee dryer speed minus the reel speed, divided by the Yankee dryer speed, expressed as a percentage. Creping is preferably carried out at a creping angle of from about 70° to about 88°, preferably about 73° to about 85° and more preferably about 80°.

The product according to the present invention is a multi-ply product. Two or more plies of tissue are adhered to one another preferably by embossing and perforating the two plies together. The embossments and perforations usually account for ply bonding.

In one alternative embodiment, the two plies may be adhered using an adhesive either alone or in conjunction with an embossing pattern. Suitable adhesives are well known and will be readily apparent to the skilled artisan. According to this embodiment, the two plies are embossed with adhesive being applied only to the tips of the raised bosses of the product and ultimately located between the two plies of the product.

The calendering and embossing of the webs preferably combines to form a multi-ply web having a specific caliper of the multi-ply web of at least about 2.8 mils/8 sheets/lb. basis weight, more preferably from about 3 to about 5 mils/8 sheets/lb basis weight and most preferably from about 3.2 to about 4.5 mils/8 sheets/lb basis weight.

The caliper of the tissue of the present invention may be measured using the Model II Electronic Thickness Tester available from the Thwing-Albert Instrument Company of Philadelphia, Pa. The caliper is measured on a sample consisting of a stack of eight sheets of tissue using a two-inch diameter anvil at a 539±10 gram dead weight load.

The tensile stiffness of the web is preferably less than 1 g/inch/% strain per pound of basis weight and more preferably at or less than about 0.58 g/% strain per pound of basis weight, most preferably less than about 0.51 g/% strain per pound of basis weight.

Tensile strength of tissue produced in accordance with the present invention is measured in the machine direction and cross-machine direction on an Instron Model 4000: Series IX tensile tester with the gauge length set to 3 inches. The area of tissue tested is assumed to be 3 inches wide by 3 inches long (the distance between the grips). In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams per 3-inch"; a more complete rendering of the units would be "grams per 3-inch by 3-inch strip." The total (sum of machine and cross machine directions) dry tensile of the present invention, when normalized for basis weight, will preferably be between about 43 and about 61 grams per 3 inches per pound per ream. The ratio of MD to CD tensile is also important and should be between about 1.25 and about 3, preferably between about 1.5 and about 2.5.

The MD tensile strength (g/3" width per lb. basis weight) is preferably from about 23 to 50, more preferably about 25 to about 35, and still more preferably about 25 to about 30. The CD tensile strength (g/3" width per lb. basis weight) is preferably from about 10 to about 23, more preferably from about 12 to about 19. Throughout this application, by basis weight, we mean basis weight in pounds per 3000 square ft. ream of the web. Many of the values provided throughout the specification have been normalized.

The stretch (also referred to as % elongation) is determined during the procedure for measuring tensile strength described above and is defined as the maximum elongation of the sample prior to failure. We have found that the emboss process of the current invention results in an increased CD stretch as compared with prior art emboss processes. This higher CD stretch results in a more flexible product and one having a lower tensile stiffness in the cross machine direction. This lower CD stiffness is of particular importance for CWP products as the CD tensile stiffness is often higher than that of the machine direction and controls the overall product stiffness level. The CD stretch of products made according to the current invention should be at least about 7.5 percent, with the ratio of the finished product CD stretch to that of the base sheet being at least about 1.5.

Tensile Energy Absorption (TEA) is defined as the area under the stress-strain curve, which is generated when a tensile strength test is performed. For most tensile test equipment, TEA values can be obtained along with tensile and elongation (stretch) values. Tensile energy absorption relates to the tissue's perceived strength. At similar tensile strength levels, higher TEA values correspond to a higher perceived strength. The values in the cross-machine direction are of primary importance, as the cross-machine direction strength of a tissue product is generally lower than its machine direction strength, making it more likely that the tissue will fail in use in the cross-machine direction. The tensile energy absorption is generally reported in units of gram-millimeter per square millimeter.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. The wet tensile of the present invention will be at least about 1.5 grams per three inches per pound per ream in the cross direction as measured using the Finch Cup, more preferably at least about 2 and most preferably at least about 2.5. Normally, only the cross direction wet tensile is tested, as the strength in this direction is normally lower than that of the machine direction and the tissue is more likely to fail in use in the cross-machine direction.

For bath tissue, it is important that the product's wet strength be of a temporary nature, so that the tissue will disintegrate fairly quickly after use without posing a clogging problem for the toilet or its associated plumbing. Insuring that a product's wet strength is temporary can be accomplished by the same wet tensile test described above with the soak time increased from five seconds to a longer time period. By comparing the sheet's initial wet tensile strength (5 second soak) to that obtained after longer soak times, the percent wet tensile remaining can be calculated. The wet strength of a product can be considered to be temporary as long as no more than about 50% of the tissue's initial wet strength (measured in the cross-machine direction) remains after a soak time of 10 minutes.

Softness is a quality that does not lend itself to easy quantification. J. D. Bates, in "Softness Index: Fact or Mirage?" *TAPPI,* Vol. 48 (1965), No. 4, pp. 63A–64A, indicates that the two most important readily quantifiable properties for predicting perceived softness are (a) roughness and (b) what may be referred to as stiffness modulus. Tissue produced according to the present invention has a more pleasing texture as measured by sidedness parameter or reduced values of either or both roughness and stiffness modulus (relative to control samples). Surface roughness can be evaluated by measuring geometric mean deviation in the coefficient of friction (GM MMD) using a Kawabata KES-SE Friction Tester equipped with a fingerprint-type sensing unit using the low sensitivity range. A 25 g stylus weight is used, and the instrument readout is divided by 20 to obtain the mean deviation in the coefficient of friction. The geometric mean deviation in the coefficient of friction or overall surface friction is then the square root of the product of the deviation in the machine direction and the cross-machine direction. The GM MMD of the single-ply product of the current invention is preferably no more than about 0.210, is more preferably less than about 0.190, and is most preferably about 0.150 to about 0.180.

The tensile stiffness (also referred to as stiffness modulus) is determined by the procedure for measuring tensile strength described above, except that a sample width of 1 inch is used and the modulus recorded is the chord slope of the load/elongation curve measured over the range of 0–50 grams load. The tensile stiffness of a tissue product is the geometric mean of the values obtained by measuring the tensile stiffness in machine and cross-machine directions. The specific tensile stiffness of the web is preferably less than about 1.0 g/inch/% strain per pound of basis weight and more preferably less than about 0.58 g/inch/% strain per pound of basis weight, most preferably less than about 0.51 g/inch/% strain per pound of basis weight.

Formation of tissues of the present invention, as represented by Kajaani Formation Index Number, should be at least about 54, preferably about 60, more preferably at least about 62, as determined by measurement of transmitted light intensity variations over the area of a single sheet of the tissue product using a Kajaani Paperlab 1 Formation Analyzer which compares the transmitivity of about 250,000 subregions of the sheet. The Kajaani Formation Index Number, which varies between about 20 and 122, is widely used through the paper industry and is for practical purposes identical to the Robotest Number which is simply an older term for the same measurement.

*TAPPI* 401 OM-88 (Revised 1988) provides a procedure for the identification of the types of fibers present in a sample of paper or paperboard and an estimate of their quantity. Analysis of the amount of the softener/debonder chemicals retained on the tissue paper can be performed by any method accepted in the applicable art. For the most sensitive cases, we prefer to use x-ray photoelectron spectroscopy ESCA to measure nitrogen levels, the amounts in each level being measurable by using the tape pull procedure described above combined with ESCA analysis of each "split." Normally the background level is quite high and the variation between measurements quite high, so use of several replicates in a relatively modern ESCA system such as at the Perkin Elmer Corporation's model 5,600 is required to obtain more precise measurements. The level of cationic nitrogenous softener/debonder such as Quasoft® 202-JR can alternatively be determined by solvent extraction of the softener/debonder by an organic solvent followed by liquid chromatography determination of the softener/debonder. *TAPPI* 419 OM-85 provides the qualitative and quantitative methods for measuring total starch content. However, this procedure does not provide for the determination of starches that are cationic, substituted, grafted, or combined with resins. These types of starches can be determined by high pressure liquid chromatography. (*TAPPI,* Journal Vol. 76, Number 3.)

The improved TEA of product, of the current invention is, in part, attributable to the amount of surface emboss used. High surface area emboss patterns are preferred. The emboss element heights are preferably less than 90 thousandths of an inch, more preferably less than 70 thousandths of an inch and most preferably 50 to 70 thousandths of an inch.

Figure 5:
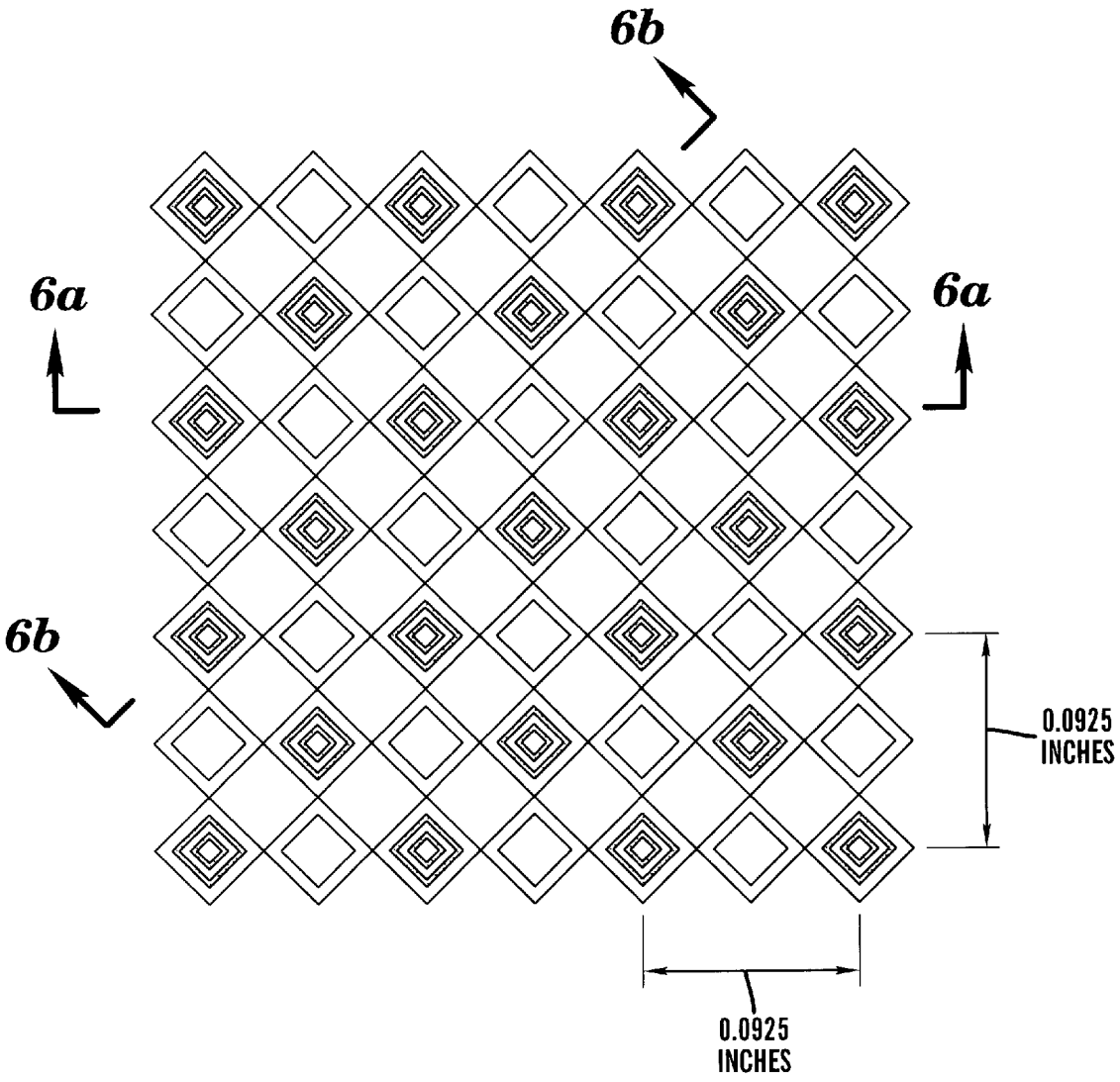
FIG. 5 illustrates one emboss pattern for use according to the present invention.
Figure 6A:
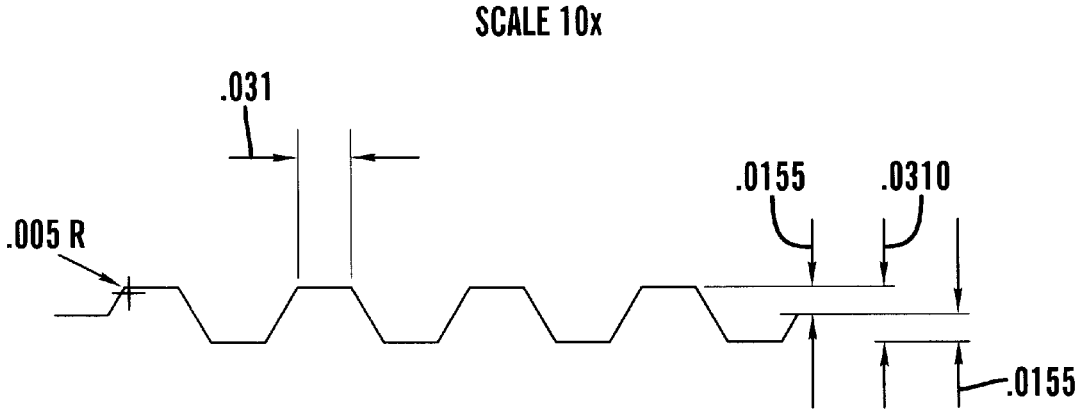
FIG. 6 illustrates the cross sections of the emboss pattern shown in FIG. 5.
Figure 6B:
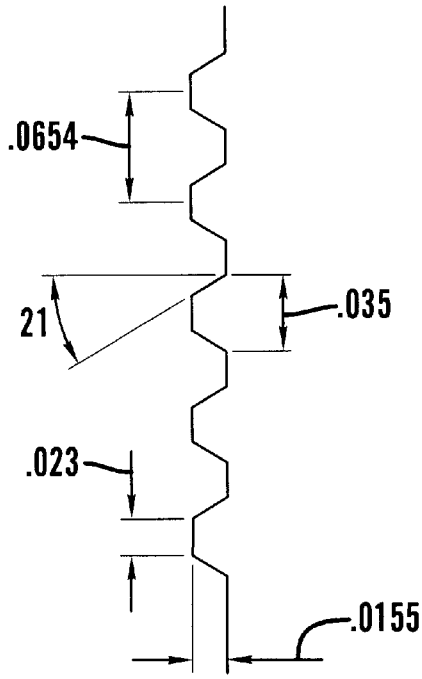

The preferred pattern according to the present invention includes "micro" elements. FIG. 5 is a depiction of a preferred emboss pattern for use with the present invention.

The typical tissue embossing process involves the compression and stretching of the flat tissue base sheet between a relatively soft (40 Shore A) rubber roll and a hard roll which has relatively large "macro" signature emboss elements. This embossing improves the aesthetics of the tissue and the structure of the tissue roll. However, the thickness of the base sheet between the signature emboss elements is actually reduced. This lowers the perceived bulk of a CWP product made by this process. Also, this process makes the tissue two-sided, as the male emboss elements create protrusions or knobs on only one side of the sheet.

Smaller, closely spaced "micro" elements can be added to the emboss pattern to improve the perceived bulk of the rubber to steel embossed product. However, this results in a harsh product. This is because small elements in a rubber to steel process create many small, stiff protrusions on one side of the tissue, resulting in a high roughness.

In the process of the present invention, the tissue is embossed between two hard rolls each of which contain both male and female elements. The micro male elements of one emboss roll are engaged or mated with the female elements of another mirror image emboss roll. These emboss rolls can be made of materials such as steel or hard rubber. In this process, the base sheet is only compressed between the sidewalls of the male and female elements. Therefore, base sheet thickness is preserved and bulk perception of a product is much improved. Also, the density and texture of the pattern improves bulk perception. This mated process and pattern also creates a softer tissue because the top of the tissue protrusions remain soft and uncompressed.

The male elements of the emboss pattern are non-discrete, that is, they are not completely surrounded by flat land area. There are an equal number of male and female elements on each emboss roll. This increases the perceived bulk of the product and makes both sides of the emboss tissue symmetrical and equally pleasing to the touch. This also doubles the bulk of the tissue with no additional reduction in strength.

Another advantage of the present invention is the type of textured surface that is created. This texture provides for better cleansing of the skin than a typically embossed CWP tissue which is very smooth in the unembossed areas. The surface of the CWP product of the present invention is better than that of a typical through-air-dried (TAD) product in that it has texture but uniformly bonded fibers. Therefore the fibers on the surface of the tissue do not pill or ball up, especially when the tissue becomes wet. In contrast, there are significant portions of the typical textured TAD tissue surface where fibers are weakly bonded. These fibers tend to pill when the tissue becomes wet, even when a significant amount of wet strength has been added to the fibers.

A preferred emboss pattern for the present invention is shown in FIG. 5. It contains diamond shaped male, female and mid-plane elements which all have a preferred width of 0.023 inches. The width is preferably between about 0.005 inches and about 0.070 inches, more preferably between about 0.015 inches and about 0.045 inches, most preferably between about 0.025 inches and about 0.035 inches. The shape of the elements can be selected as circles, squares or other easily understood shapes. When a micro and macro pattern are used, the distance between the end of the macroelements and the start of the microelements is preferably between about 0.007 inches and about 1 inch, more preferably between about 0.005 and about 0.045, and most preferably between about 0.010 and about 0.035. The height of the male elements above the mid-plane is preferably about 0.0155 inches and the depth of the female elements is preferably about 0.0155 inches. The angle of the sidewalls of the elements is preferably between about 10 and about 30 degrees, more preferably between about 19 and 23 degrees, most preferably about 21 degrees. In a most preferred embodiments, the elements are about 50% male and about 50% female.

Patterns such as those shown in FIG. 5 can be combined with one or more signature emboss patterns to create products of the present invention. Signature bosses are made up of any emboss design and are often a design which is related by consumer perception to the particular manufacturer of the tissue.

Figure 7A:
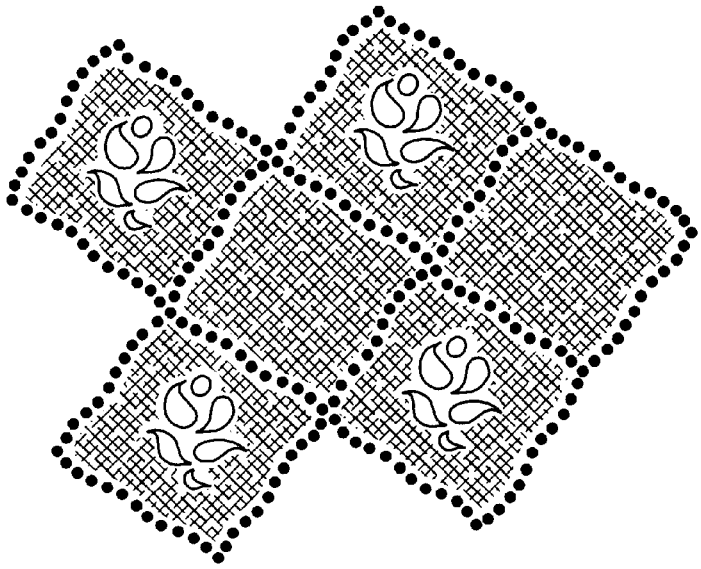
Figure 7B:
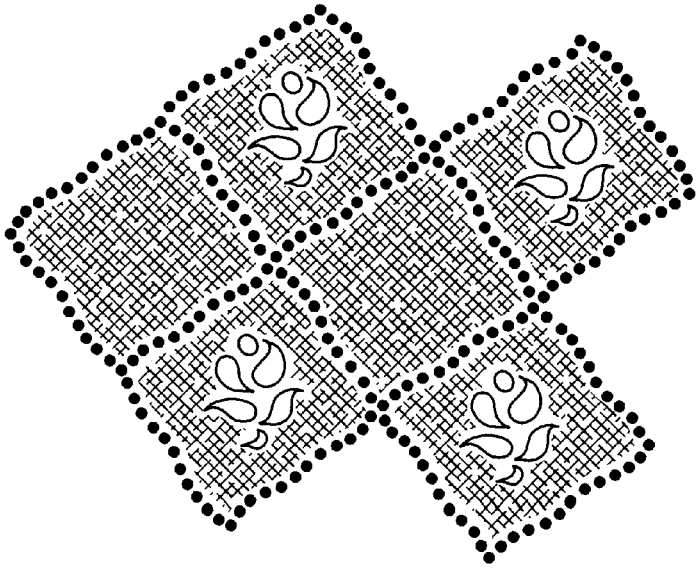

More preferred emboss patterns for the present invention are shown in FIGS. 7*a* and 7*b*. These patterns are exact mirror images of one another. These emboss patterns combine the diamond micro pattern in FIG. 5 with a large, signature or "macro" pattern. This combination pattern provides aesthetic appeal from the macro pattern as well as the improvement in perceived bulk and texture created by the micro pattern. The macro portion of the pattern is mated so that it does not reduce softness by increasing the friction on the back side of the sheet. In addition to providing improved aesthetics, this pattern minimizes nesting and improves roll structure by increasing the repeat length for the pattern from 0.0925 inches to 5.0892 inches.

The design of the macro elements in the more preferred emboss pattern preserves strength of the tissue. This is done by starting the base of the male macroelements at the mid-plane of the pattern as shown in FIG. 8*a*. The female macro elements are started at the mid-plane as shown in FIG. 8*b*. This reduces the stretching of the sheet from the mid-plane by 50%. However, because the macro elements are still 31 mils in height or depth, they still provide a crisp, clearly defined pattern.

The more preferred emboss pattern has the bases of male microelements and the opening of female microelements kept at least 0.014 inches away from the base of male macroelements or openings of female macroelements. This ameliorates the emboss rolls from plugging with tissue.

It is also possible to put some of the male macroelements going one direction and the rest of them going the other direction. This may further reduce any sidedness in the product.

The following examples are not to be construed as limiting the invention as described herein.

EXAMPLE 1

Two layer stratified tissue base sheet were formed on a twin-wire paper machine. The sheet's outer layer, which constituted 44% of the total furnish, was composed of hardwood having a coarseness of 11.1 mg/100 m and a fiber length of 1.33 mm. The inner layer of the sheet was composed of an 82/18 blend of softwood having a coarseness of 17.8 mg/100 m and a fiber length of 3.12 mm and broke. The overall furnish of the total sheet had a coarseness of 14.0 mg/100 m. A temporary wet strength agent was added to the sheet in the amount 2 lbs/ton. Five pounds per ton of a nitrogenous debonder was added to the sheet. A softener was sprayed onto the sheet at a rate of 0.5 lbs/ton. The sheets were creped at a percent crepe of 25%, calendered, and then slit to prepare them for converting as two-ply products. The average physical properties of the base sheets are shown in Table 1, below.

TABLE 1

| Base Sheet Physical Properties | | | | | | | |
|---|---|---|---|---|---|---|---|
| Basis Weight (lbs/ream) | Caliper (mils/8 sheets) | MD Tensile (grams/3 inches) | CD Tensile (grams/3 inches) | GM Tensile (grams/3 inches) | MD Stretch (%) | CD Stretch (5) | CD Wet Tensile (grams/3 inches) |
| 13.3 | 37.6 | 561 | 313 | 419 | 27.7 | 7.4 | 50 |

Figure 4:
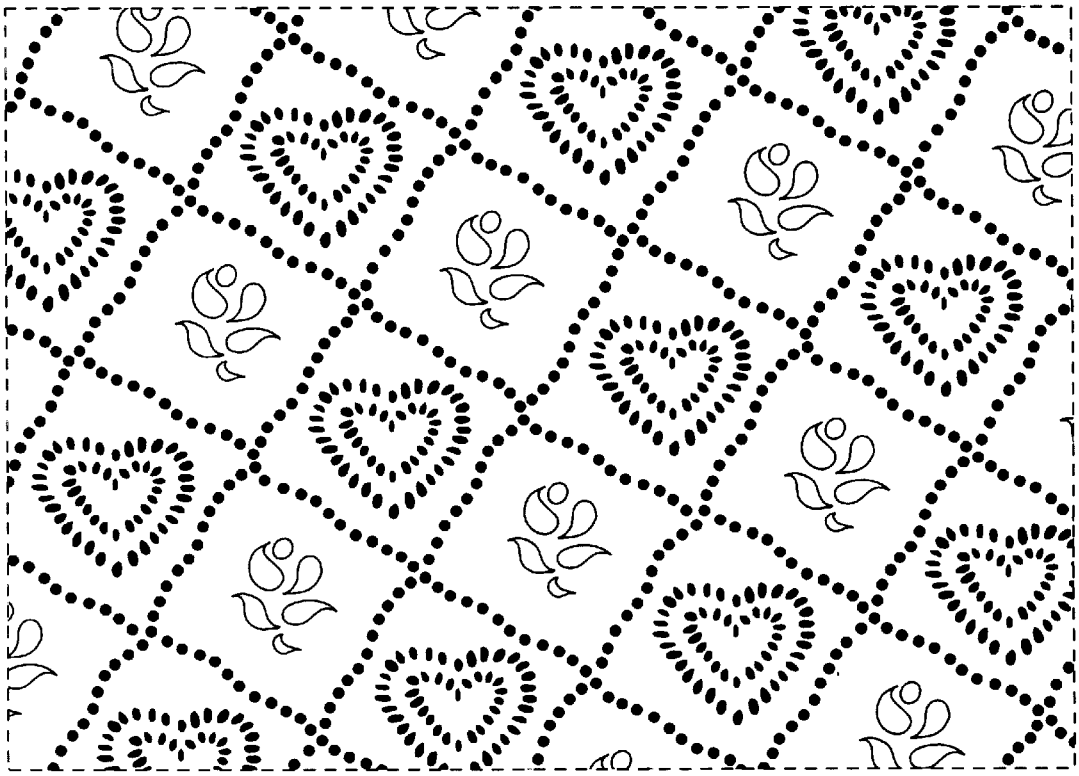
FIG. 4 illustrates an emboss pattern according to the Prior Art.

Two slit base sheet rolls were plied together and embossed to create two-ply products. The products were embossed using the prior art conventional emboss process with the emboss pattern shown in FIG. 4. Samples were made at emboss penetrations of 0.80, 0.90, 0.100 and 0.110 inches. The sheets were not calendered after embossing so that the actual caliper generated by the emboss process could be determined. Samples were also produced from two ply base sheets using the emboss process of the current invention with the emboss pattern shown in FIGS. 7*a* and 7*b*. Samples were not calendered after embossing. The emboss settings were chosen so that products having roughly equivalent strengths after embossing would be produced. The products were tested for physical properties.

The caliper generated by the two emboss methods are compared in FIG. 1. FIG. 1 shows that for low emboss penetrations using the prior art emboss process or at high emboss gaps using the mated emboss process of the current invention, the level of caliper generated at a given tensile strength is essentially equivalent for either process. However, at higher emboss levels (corresponding to an increased penetration depth or a decreased emboss gap) the caliper generated by the mated emboss process far exceeds that produced by conventional embossing. This higher level of caliper is important as it allows the embossed product to be calendered after embossing to improve product softness while still maintaining a desired product thickness.

Figure 3:
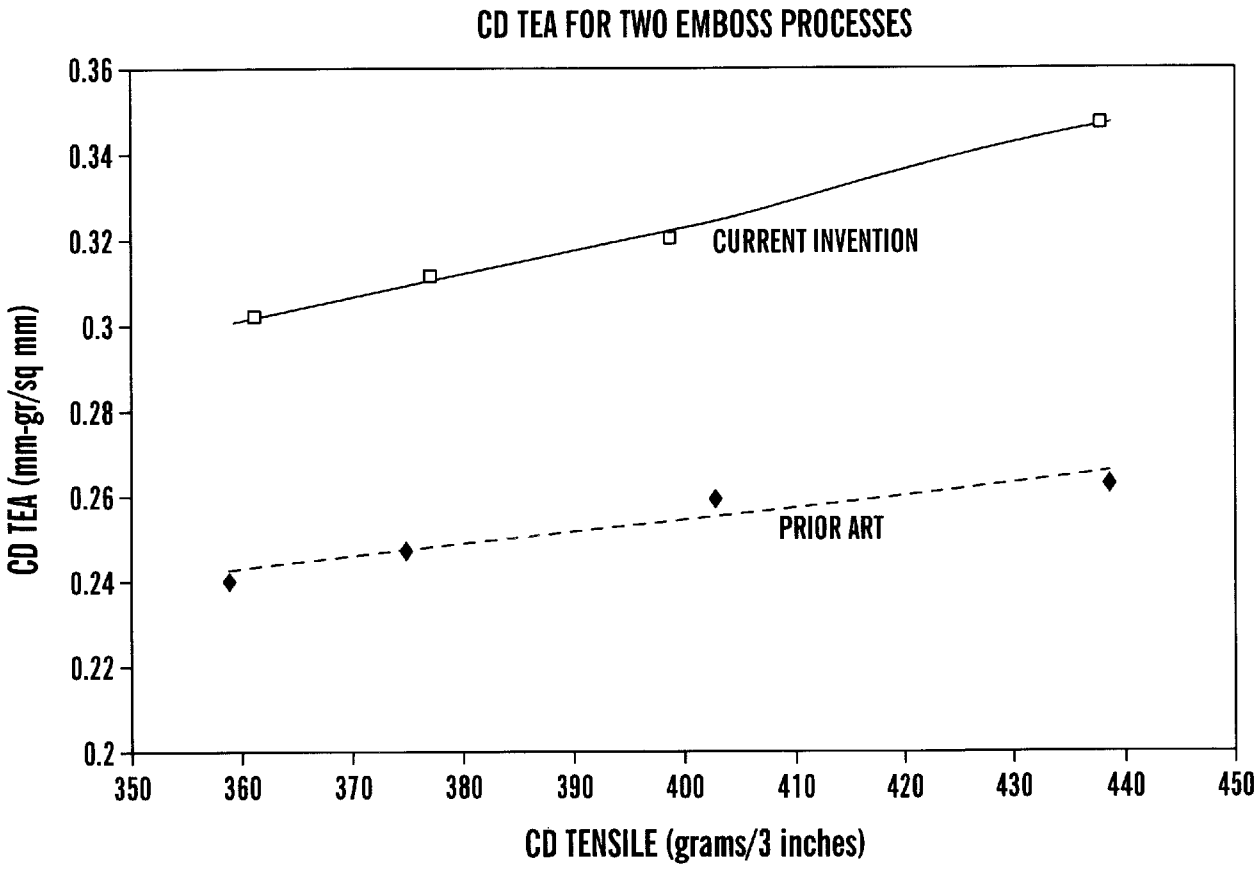
FIG. 3 is a graphical representation of the cross-direction tensile vs. the cross-direction tensile absorption energy for products produced according to the Prior Art and those produced according to the present invention.

FIG. 3 shows the cross machine direction tensile energy absorption (TEA) values of the embossed products. As can be seen from the figure, the cross-machine direction TEA is substantially higher for the products of the current invention than is the case for those of the prior art.

EXAMPLE 2

Two two-layer stratified base sheets were produced on a crescent former paper machine. The outer layer of both sheets constituted 35% of the total sheet. For one of the base sheets, the outer layer was composed of 100% Southern hardwood kraft having a coarseness of 11.9 mg/100 m and a fiber length of 1.43 mm. The other base sheet had an outer layer of 100% Northern hardwood kraft which has a coarseness of 8.9 mg/100 m and a fiber length of 0.96 mm. For both base sheets, the inner layer was composed of 2/1 blend of Southern softwood kraft and Southern hardwood kraft. The Southern hardwood kraft was from the same lot as was used in the outer layer of the sheet of Example 1 mentioned above, while the Southern softwood kraft had a coarseness of 24.4 mg/100 m and a fiber length of 3.58 mm. The overall coarseness of the total sheet for these two base sheets were 14.3 and 13.0 respectively.

A temporary wet strength agent, Cobond 1600, was added to both base sheets in the amount of 8.5 lbs/ton. Both base sheets were treated with two pounds per ton of a softener, which was sprayed onto the sheets while the sheets were on the machine felt. For the second base sheet only, two pounds per ton of a debonder were added to the outer layer's furnish. Refining of the sheets' inner layer was used to control sheet strength for both base sheets. The average physical properties of the two base sheets are shown in Table 2.

TABLE 2

Base Sheet Physical Properties

| Base Sheet ID# | Basis Weight (lbs/ream) | Caliper (mils/8 sheets) | MD Tensile (grams/3 inches) | CD Tensile (grams/3 inches) | GM Tensile (grams/3 inches) | MD Stretch (%) | CD Stretch (%) | CD Wet Tensile (grams/3 inches) |
|---|---|---|---|---|---|---|---|---|
| 1 | 13.7 | 46.2 | 549 | 347 | 436 | 29.0 | 5.4 | 57 |
| 2 | 13.5 | 44.6 | 523 | 343 | 423 | 29.5 | 4.7 | 72 |

Each base sheet was embossed using both prior art conventional technology and the mated technology of the current invention. For the sheets made using the conventional emboss technology, the penetration depth was 0.120 inches and the sheets were calendered after embossing using feed rolls wet at a gap of 0.009 inches. The base sheets that employed the emboss technology of the current invention were converted using an emboss gap of 0.011 inches and were calendered at a feed roll gap of 0.008 inches. The physical properties of the embossed products are shown in Table 3.

TABLE 3

Embossed Product Physical Properties

| Base Sheet ID# | Emboss Technology | Basis Weight (lbs/ream) | Caliper (mils/8 sheets) | MD Tensile (grams/3 inches) | CD Tensile (grams/3 inches) | MD Stretch (%) | CD Stretch (%) | CD Wet Tensile (grams/3 inches) | Opacity (%) | MD TEA (mm-g/ sq-mm) | CD TEA (mm-g/ sq-mm) | Tensile Stiffness (grams/ inch/% strain) | Friction Deviation |
|---|---|---|---|---|---|---|---|---|---|---|---|---|---|
| 1 | Prior Art | 26.1 | 110.1 | 707 | 339 | 17.9 | 7.8 | 79 | 63.4 | 0.811 | 0.182 | 12.9 | 0.178 |
| 1 | Current Invention | 26.0 | 110.2 | 733 | 364 | 18.9 | 8.6 | 83 | 64.8 | 0.904 | 0.231 | 13.7 | 0.189 |

TABLE 3-continued

Embossed Product Physical Properties

| Base Sheet ID# | Emboss Technology | Basis Weight (lbs/ream) | Caliper (mils/8 sheets) | MD Tensile (grams/3 inches) | CD Tensile (grams/3 inches) | MD Stretch (%) | CD Stretch (%) | CD Wet Tensile (grams/3 inches) | Opacity (%) | MD TEA (mm-g/ sq-mm) | CD TEA (mm-g/ sq-mm) | Tensile Stiffness (grams/ inch/% strain) | Friction Deviation |
|---|---|---|---|---|---|---|---|---|---|---|---|---|---|
| 2 | Prior Art | 25.1 | 107.1 | 657 | 328 | 16.9 | 7.1 | 87 | 62.5 | 0.681 | 0.156 | 12.7 | 0.183 |
| 2 | Current Invention | 25.3 | 104.5 | 667 | 357 | 23.3 | 8.0 | 101 | 64.9 | 0.992 | 0.214 | 13.7 | 0.186 |

As can be seen from Table 3, many of the physical properties of the products embossed using the two technologies are similar; however, the CD TEA values of the products of the current invention are 17–27 percent higher than their conventional-embossed counterparts. It can also be seen that the opacity values of the products of the current invention are higher than those products employing the prior art technology. A higher opacity can be useful in improving the perceived thickness of the tissue product.

The following Table 4 shows the product attributes having been normalized for basis weight.

TABLE 4

Normalized Values of Embossed Product Physical Properties

| Base Sheet ID# | Emboss Technology | Caliper (mils/8 sheets/lb/ream) | MD Tensile (grams/3 in/lb/ream) | CD Tensile (grams/3 in/lb/ream) | CD Wet Tensile (grams/3 in/lb/ream) | Tensile Stiffness (gr/in/%/lb/ream) |
|---|---|---|---|---|---|---|
| 1 | Prior Art | 4.22 | 27.1 | 13.0 | 3.0 | 0.49 |
| 1 | Current Invention | 4.23 | 28.2 | 14.0 | 3.2 | 0.53 |
| 2 | Prior Art | 4.27 | 26.2 | 13.1 | 3.5 | 0.51 |
| 2 | Current Invention | 4.13 | 26.4 | 14.1 | 4.0 | 0.54 |

The four products were also tested by a trained panel to determine their softness levels. In a sensory softness test, trained panelists compared the softness of the test product to that of anchor products. The softness values of the anchor products have been fixed by comparing the products' softness to each other in paired comparisons and using the Thurstone algorithm to determine interval scale differences between products. The Thurstone algorithm and its use are described in the article: Thurstone, *Psychological Review,* 34, 1927, pp. 273–286, which is incorporated herein by reference in its entirety. After the differences between the anchor products have been established, they are assigned absolute values by assigning an arbitrary value to the top (softest) anchor product and using the differences between successively less soft products to assign absolute softness values to them. To determine the softness of a test product, panelists compare its softness to that of the anchor products that are just softer and less soft than the test product. Typically, two test products and the two anchor products are tested using six comparisons in a full factorial array. Using these results and the Thurstone algorithm, the absolute softness value of the test products may be obtained. The results of this test are shown in Table 5. The table shows that the products of the current invention are at least as soft or softer than their prior art counterparts, despite being slightly stronger.

TABLE 5

Softness of Embossed Products

| Base Sheet ID# | Emboss Technology | Softness Value |
|---|---|---|
| 1 | Prior Art | 18.30 |
| 1 | Current Invention | 18.54 |
| 2 | Prior Art | 18.70 |
| 2 | Current Invention | 19.36 |

EXAMPLE 3

A two-layer stratified base sheet was produced on a crescent former paper machine. The outer layer of the base sheet constituted 35% of the total sheet and was composed of 100% Southern hardwood kraft having a coarseness of 11.9 mg/100 m and a fiber length of 1.43 mm. The inner layer was composed of 2/1 blend of Southern softwood kraft and Southern hardwood kraft. The Southern hardwood kraft was from the same lot as was used in the outer layer of the sheet of Example 1 mentioned above, while the Southern softwood kraft had a coarseness of 24.4 mg/100 m and a fiber length of 3.58 mm. The combined coarseness of the fibers used to create the base sheet was 14.3. This coarseness value for this product is substantially higher than the coarseness of 11.0 or less that is typical of fiber blends used in ultra-soft premium tissues.

A temporary wet strength agent, CoBond 1600, was added to the base sheet in the amount of 8.5 lbs/ton. The base sheet was treated with 2 lbs/ton of a softener which was sprayed onto the sheet while the sheet was on the machine's felt. Refining of the sheet's inner layer was used to control sheet strength.

Two base sheet rolls were plied together and embossed to create a two-ply product using the emboss technology of the current invention. An emboss gap of 0.011 inches was used followed by calendering with a feed roll gap of 0.008 inches.

Figure 9:
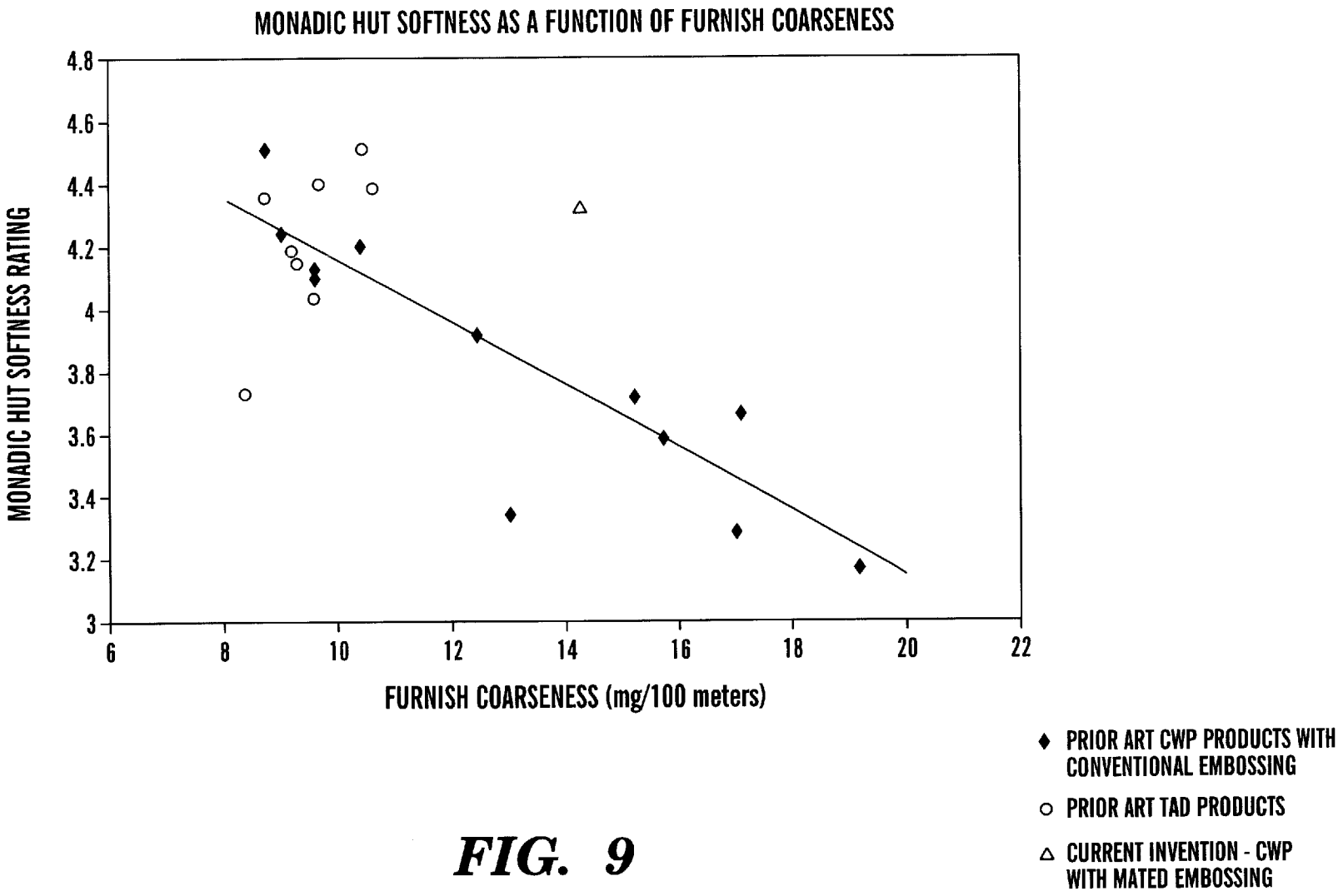
FIG. 9 graphically represents the Monadic Hut softness ratings vs. furnish coarseness for products produced according to the Prior Art, both with conventional wet pressing and through-air drying, and a product produced according to the present invention.

The resulting product was tested alone by consumers in a Monadic Home Use Test. Monadic Home Use Tests are described in the Blumkenship and Green textbook "State of the Art Marketing Research", NTC Publishing Group, Lincolnwood, Ill., 1993, which is herein incorporated by reference in its entirety. In a Monadic Home Use Test (HUT) of a bathroom tissue, consumers are given a single product to use for several days and are then asked to rate the product for overall performance as well as for several product attributes. Each attribute may be assigned a rating of "Excellent", "Very Good", "Good", "Fair", or "Poor". For tabulation purposes, these ratings are assigned numerical values from 1 to 5, with 5 corresponding to an "Excellent" rating and 1 corresponding to a rating of "Poor". By totaling the rating scores given by all respondents and dividing by the number of respondents, an average attribute rating between 1 and 5 may be obtained. FIG. 9 shows that the product achieved a very high softness score of 4.35. This score is in the softness range of super premium products that use expensive premium pulps with coarseness values of 11.0 or less exclusively. FIG. 9 also shows that the softness score obtained by the product of the current invention is much higher than scores of products made from fibers with equivalent coarseness values.

EXAMPLE 4

It might be expected that in order to obtain the high softness rating for Product 1 (described in Example 3) that other attributes would be degraded. If other attributes were degraded then this would most likely result in a lower overall consumer rating compared to a product made with conventional wet press base sheet, premium fibers and prior art embossing. Store shelf product made with conventional wet press base sheet, premium fibers and prior art embossing (pattern shown in FIG. 4) was tested alone in a consumer home use test using the same protocol as the product according to Example 3.

Table 6 summarizes the results of the home use tests for the prior art product and the product according to Example 3. In addition to its high softness rating, the product according to Example 3 scored significantly higher than the prior art product for all other key attributes. The overall rating for the product according to Example 3 was directionally higher than the prior art product.

TABLE 6

Consumer Home Use Test Ratings

| Consumer Rated Attribute | Control (Store Shelf product with prior art embossing and all premium fibers): coarseness = about 9.2 | Product according to Example 3 with coarseness = about 14.3 |
|---|---|---|
| Overall Rating | 3.95 | 4.14 |
| Softness | 4.08 | 4.35 |
| Strength | 3.99 | 4.28 |
| Thickness | 3.90 | 4.22 |
| Absorbency (speed and thoroughness) | 3.81 | 4.12 |
| Cleansing Ability | 3.92 | 4.24 |
| Length of time Roll Lasts | 3.06 | 3.47 |

The net result of the current invention is that it provides a premium or super premium product using cheaper coarser fibers while achieving high consumer perceived softness rating normally associated with exclusive use of premium fibers. Also products according to the present invention have improved thickness, absorbency and strength due to the bulkiness of these coarse fibers.

EXAMPLE 5

A homogenous base sheet was produced on a crescent former paper machine. The furnish for this base sheet constituted 30% of a Southern softwood kraft pulp that had a fiber length of 3.58 mm and a coarseness of 24.4 mg/100 m and 70% of a Southern hardwood kraft pulp which had a fiber length of 1.43 mm and a coarseness of 11.9 mg/100 m. These fibers used were the same as those used to produce the stratified base sheet designated base sheet #1 in Example 2. The coarseness of the blended furnish was 13.2.

A temporary wet strength agent, Parez 745, was added to the furnish in the amount of 3.5 lbs/ton. One lb/ton of a cationic dry-strength starch, Solvitose N, was also added to the furnish. The sheet was treated with two pounds per ton of softener, which was sprayed onto the sheet while it was on the paper-machine felt. The average base sheet physical properties are shown in Table 7.

TABLE 7

| Base Sheet Physical Properties | | | | | | | |
|---|---|---|---|---|---|---|---|
| Basis Weight (lbs/ream) | Caliper (mils/8 sheets) | MD Tensile (grams/3 inches) | CD Tensile (grams/3 inches) | GM Tensile (grams/3 inches) | MD Stretch (%) | CD Stretch (%) | CD Wet Tensile (grams/3 inches) |
| 13.6 | 43.5 | 506 | 335 | 412 | 26.8 | 5.6 | 68 |

Two base sheet plies were combined and embossed using the mated technology of the current invention at an emboss gap of 0.0095 inches and were calendered at a feed roll gap of 0.004 inches. The finished product physical properties are shown in Table 8.

TABLE 8

| Embossed Product Physical Properties | | | | | |
|---|---|---|---|---|---|
| Basis Weight (lbs/ream) | Caliper (mils/8 sheets) | MD Tensile (grams/3 inches) | CD Tensile (grams/3 inches) | MD Stretch (%) | CD Stretch (%) |
| 25.6 | 101.0 | 728 | 339 | 16.1 | 8.5 |
| CD Wet Tensile (grams/3 inches) | Opacity (%) | MD TEA (mm-g/sq-mm) | CD TEA (mm-g/sq-mm) | Tensile Stiffness (grams/inch/ % strain) | Friction Deviation |
| 65 | 65.6 | 0.788 | 0.219 | 14.2 | 0.158 |

As can be seen from the table, this product has similar physical properties to the stratified-base-sheet product made from these fibers that is described in Example 2. It can also be seen that the homogenous product has a higher opacity and CD TEA than does the prior-art tissue described in Example 2.

The sensory softness of the homogenous product was tested by a trained panel and was found to be 18.30. This value is equal to that of the prior-art product and is not statistically different (95% confidence level) from the stratified product of the current invention described in Example 2. This example demonstrates that products of the current invention can also be produced from homogenous base sheets.

EXAMPLE 6

A stratified tissue base sheet was produced on a twin-wire tissue machine. The sheet's outer layer, which constituted 44% of the total furnish, was composed of hardwood having a fiber length of 1.33 mm and a coarseness of 11.1 mg/100 meters. The remainder of the sheet was composed of an 82/18 blend of softwood and broke. The softwood had a fiber length of 3.06 mm and a coarseness of 17.7 mg/100 meters. The coarseness of the overall sheet furnish was 13.6 mg/100 meters. Four pounds per ton of a nitrogenous debonder and 1.75 pounds per ton of a temporary wet strength agent were added to the furnish in the paper machine wet end. A softener was sprayed on the sheet while it was on the machine felt at a rate of 0.5 pounds per ton. The base sheet was creped at a twenty-five percent crepe, calendered, and then slit to prepare it for converting as a two-ply product. The average base-sheet physical properties are shown in Table 9.

TABLE 9

| Base Sheet Physical Properties | | | | | | | |
|---|---|---|---|---|---|---|---|
| Basis Weight (lbs/ream) | Caliper (mils/8 sheets) | MD Tensile (grams/3 inches) | CD Tensile (grams/3 inches) | GM Tensile (grams/3 inches) | MD Stretch (%) | CD Stretch (%) | CD Wet Tensile (grams/3 inches) |
| 13.88 | 43.0 | 599 | 329 | 444 | 30 | — | 54 |

Two base sheet plies were combined and embossed using the mated technology of the current invention at an emboss gap of 0.006 inches and were calendered at a feed roll gap of 0.006 inches. The finished product physical properties are shown in Table 10.

TABLE 10

| Embossed Product Physical Properties | | | | | |
|---|---|---|---|---|---|
| Basis Weight (lbs/ream) | Caliper (mils/8 sheets) | MD Tensile (grams/3 inches) | CD Tensile (grams/3 inches) | MD Stretch (%) | CD Stretch (%) |
| 25.9 | 109.3 | 842 | 424 | 20.8 | 10.1 |
| CD Wet Tensile (grams/ 3 inches) | Opacity (%) | MD TEA (mm-g/sq-mm) | CD TEA (mm-g/sq-mm) | Tensile Stiffness (grams/inch/ % strain) | Friction Deviation |
| 63 | 66.9 | 1.144 | 0.319 | 12.8 | 0.167 |

The embossed product was tested in a Monadic Home Use Test as described above. A high-weight, high softness store-shelf product made using conventional wet press technology, premium low-coarseness fiber, and prior-art embossing was also tested using the same protocol. The results of the test are shown in Table 11, below. These results indicate that the coarse-fiber product of the current invention is at parity to the prior-art product made from all premium fibers for overall quality and-for important tissue attributes.

TABLE 11

| Consumer Home Use Test Ratings | | |
|---|---|---|
| Consumer Rated Attribute | Control (Store Shelf Product with prior art embossing and all premium fibers) Coarseness = about 9.2 | Product according to Example 6 Coarseness = 13.6 |
| Overall Rating | 3.92 | 4.03 |
| Softness | 4.19 | 4.07 |
| Strength | 4.04 | 4.04 |
| Thickness | 3.83 | 3.96 |
| Absorbency | 4.03 | 3.96 |
| Cleansing Ability | 4.08 | 3.98 |
| Length of time roll lasts | 3.25 | 3.36 |

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. An embossed multi-ply tissue product comprising at least two paper webs with at least about 1 lb/ton of softener and having a fiber coarseness of at least about 11 mg/100 meters; an MD tensile strength of from about 21 to about 50 g/3" width per lb. of basis weight; a CD tensile strength of from about 10 g to about 23 g/3" width per lb. of basis weight; a caliper of at least about 3 mils/8 plies/lb. basis weight; a GM MMD friction of less than about 0.21; a tensile stiffness of less than about 1 g/% strain per lb. of basis weight; and a CD tensile absorption energy according to the following relationship $$\text{CD TEA} \geqq \text{CDT}*0.00085-0.105.$$

2. The product of claim 1, wherein the furnish contains recycled and/or nonwoody fibers in an amount of less than about 70% of the total furnish.

3. The product of claim 1, wherein the basis weight of one of said at least two paper webs is at least about 10 lbs/3000 sq. ft. ream.

4. The product of claim 1, further comprising a temporary wet strength adjusting agent.

5. The product of claim 4, wherein the temporary wet strength agent is an aliphatic aldehyde, aromatic aldehyde, a polymeric reaction product of a monomer or polymer having an aldehyde group and optionally a nitrogen group, or any combination thereof.

6. The product of claim 5, wherein the temporary wet strength agent is glyoxal, malonic dialdehyde, succinic dialdehyde, glutaraldehyde, dialdehyde starch, a cyclic urea containing an aldehyde moiety, a polyol containing aldehyde moiety, a reaction product of an aldehyde containing monomer or polymer and a vinyl-amide or acrylamide polymer, a glyoxylated acrylamide polymer or glyoxylated vinyl-amide or mixtures thereof.

7. The product of claim 1, wherein the softener is a trivalent cationic organic nitrogen compound incorporating long fatty acid chains, a tetravalent organic nitrogen compound incorporating long fatty acid chains, an imidazoline, an amino acid salt, a linear amine amide, a tetravalent quaternary ammonium salt, a quatenary ammonium salt, an amido amine salt derived from a partially neutralized amine, or any combination thereof.

8. The product of claim 1, wherein the MD tensile strength of said multi-ply web to from about 30 g to about 35 g/3" width per pound of basis weight.

9. The product of claim 1, wherein from about 1 to about 10 lbs./ton of softener is added.

10. The product of claim 9, wherein the softener is included in the fibrous pulp furnish prior to web formation or applied to the web after dewatering, or both.

11. The product of claim 9, wherein the softener is applied to the web after creping.

12. The product of claim 1, wherein the multi-ply tissue has a specific caliper of from about 2.5 to about 5 mils/8 plies/lb. basis weight.

13. The product of claim 1, wherein said combined webs are embossed with mated emboss rolls each of which contain both male and female elements.

14. The product of claim 13, wherein the emboss pattern used has male microelements and female microelements and wherein the largest dimension of the top of the male microelements and the bottom of the female microelements is from about 0.005 inches to about 0.07 inches.

15. The product of claim 14, wherein the largest dimension of the top of the male microelements and the bottom of the female microelements is from about 0.015 inches to about 0.045 inches.

16. The product of claim 15, wherein the largest dimension of the top of the male microelements and the bottom of the female microelements is from about 0.024 inches to about 0.035 inches.

17. The product of claim 13, wherein the emboss pattern used has male microelements and the female microelements and wherein the elements are about 50% male and about 50% female.

18. The product of claim 13, wherein the emboss pattern used has male microelements and female microelements and wherein the angle of the sidewalls of the emboss microelements is from about 10 degrees to about 30 degrees from the vertical.

19. The product of claim 18, wherein the emboss pattern used has male microelements and female microelements and wherein the angle of the sidewalls of the emboss microelements is from about 18 degrees to about 23 degrees from the vertical.

20. The product of claim 13, wherein the emboss pattern used has male microelements and female microelements and wherein the length of the elements divided by the width of the elements is less than 3.

21. The product of claim 13, wherein the emboss pattern used has male microelements and female microelements and wherein the length of the elements divided by the width of the elements is less than 2.

22. The product of claim 13, wherein the emboss pattern used has male microelements and female microelements and wherein the length of the elements divided by the width of the elements is 1.

23. The product of claim 13, wherein the emboss pattern used has both microelements and macroelements and wherein the base of a male macroelement or the opening of a female element begins at the mid-plane of the microelements.

24. The product of claim 13, wherein the emboss pattern used has both microelements and macroelements and wherein the distance between the end of the macroelements and the start of the microelements is at least about 0.007 inches and not greater than about 1 inch.

25. The product of claim 13, wherein the emboss pattern used has microelements and the depth or height of the microelements from the midplane is from about 0.005 to about 0.045 inches.

26. The product of claim 25 wherein the emboss pattern used has microelements and the depth or height of the microelements from the midplane is from about 0.01 to about 0.035 inches.

27. The product of claim 26, wherein the emboss pattern used has microelements and the depth or height of the microelements from the midplane is from about 0.015 to about 0.02 inches.

28. The product of claim 13, wherein the emboss pattern used has macroelements and the depth or height of the macroelements is from about 0.01 to about 0.055 inches.

29. The product of claim 28, wherein the emboss pattern used has macroelements and the depth or height of the macroelements is from about 0.02 to about 0.045 inches.

30. The product of claim 13 wherein the emboss pattern used has macroelements and the depth or height of the macroelements is from about 0.025 to about 0.035 inches.

31. The product of claim 1, wherein said multi-ply web has a CD tensile strength of from about 12 g to about 17 g/3" width/lb basis weight.

32. The product of claim 1, wherein said multi-ply web has a specific caliper of at least about 3.5 mils/8 plies/lb basis weight.

33. The product of claim 1, wherein said multi-ply web has a GM MMD of not more than about 0.175.

34. The product of claim 1, wherein said multi-ply web has a tensile stiffness of not more than about 0.58.

35. The product of claim 34, wherein the tensile stiffness is less than about 0.51.

36. The product of claim 1, wherein each of said first and second webs are calendered individually.

37. The product of claim 1, wherein said multi-ply web is calendered.

* * * * *